US011293246B2

(12) United States Patent
Carisella et al.

(10) Patent No.: US 11,293,246 B2
(45) Date of Patent: Apr. 5, 2022

(54) DOWNHOLE PLACEMENT TOOL WITH FLUID ACTUATOR AND METHOD OF USING SAME

(71) Applicant: NON-EXPLOSIVE OILFIELD PRODUCTS, LLC, Harahan, LA (US)

(72) Inventors: James V. Carisella, Harahan, LA (US); Kevin M Morrill, Harahan, LA (US); Jay M. Lefort, Harahan, LA (US)

(73) Assignee: Non-Explosive Oilfield Products, LLC, Harahan, LA (US)

( * ) Notice: Subject to any disclaimer, the term of this patent is extended or adjusted under 35 U.S.C. 154(b) by 158 days.

(21) Appl. No.: 16/759,720

(22) PCT Filed: Oct. 24, 2018

(86) PCT No.: PCT/US2018/057388
§ 371 (c)(1),
(2) Date: Apr. 27, 2020

(87) PCT Pub. No.: WO2019/084192
PCT Pub. Date: May 2, 2019

(65) Prior Publication Data

US 2020/0347686 A1 Nov. 5, 2020

Related U.S. Application Data

(60) Provisional application No. 62/662,395, filed on Apr. 25, 2018, provisional application No. 62/577,586, filed on Oct. 26, 2017.

(51) Int. Cl.
*E21B 27/02* (2006.01)
*E21B 33/13* (2006.01)

(52) U.S. Cl.
CPC ..... *E21B 27/02* (2013.01); *E21B 33/13* (2013.01)

(58) Field of Classification Search
CPC ..... E21B 33/13; E21B 27/02
See application file for complete search history.

(56) References Cited

U.S. PATENT DOCUMENTS 1,476,747 A 12/1923 Wolever
2,141,179 A 12/1938 Ennis
(Continued)

OTHER PUBLICATIONS

HPI, Chapter 2, "Tubing & Thru-Tubing Bridge Plugs", High Pressure Integrity, Inc., 2008 Weatherford35 pages.
(Continued)

*Primary Examiner* — Robert E Fuller
(74) *Attorney, Agent, or Firm* — J L Salazar

(57) ABSTRACT

A downhole placement tool includes an actuation (122) and a placement assembly. The actuation assembly includes a housing (226*a*) having a fluid pathway therethrough and an actuation piston seated in the housing to block the fluid pathway. The actuation piston is movable by fluid applied thereto to open the fluid pathway and allow the fluid to pass therethrough. The placement assembly is connected to the actuation assembly (122), and includes a housing (226*b*) having a pressure chamber (217*b*) to store the wellbore material (103) therein, a door (219), and a placement piston. The placement piston includes a piston head (264*a*) slidably movable in the housing, and a rod (264*b*) connected between the piston head (264*a*) and to the door (219). The piston head (264*a*) is movable in response to the flow of the fluid from the actuation assembly (122) into the placement assembly to advance the placement piston and open the door (219) whereby the wellbore material (103) is selectively released into the wellbore.

33 Claims, 29 Drawing Sheets

(56) References Cited

U.S. PATENT DOCUMENTS

| | | | |
|---|---|---|---|
| 2,526,021 | A | 10/1950 | Fultz |
| 2,618,345 | A | 11/1952 | Tucker |
| 2,653,666 | A | 9/1953 | Baker |
| 2,695,065 | A | 11/1954 | Baker et al. |
| 2,707,998 | A | 5/1955 | Baker et al. |
| 3,064,734 | A | 11/1962 | Toelke |
| 3,125,162 | A | 3/1964 | Briggs, Jr. |
| 3,160,209 | A | 12/1964 | Bonner |
| 3,186,485 | A | 6/1965 | Owen |
| 3,199,597 | A | 8/1965 | Kelly |
| 3,246,708 | A | 4/1966 | Harrigan, Jr. et al. |
| 3,294,171 | A | 12/1966 | Kelley |
| 3,378,078 | A | 4/1968 | Current |
| 3,650,325 | A | 3/1972 | Owens |
| 3,768,408 | A | 10/1973 | Hallmark |
| 3,891,034 | A | 6/1975 | Owen et al. |
| 4,208,966 | A | 6/1980 | Hart |
| 4,253,521 | A | 3/1981 | Savage |
| 4,493,374 | A | 1/1985 | Magee, Jr. |
| 4,696,343 | A | 9/1987 | Anderson et al. |
| 4,739,829 | A | 4/1988 | Brunner |
| 4,741,396 | A | 5/1988 | Falxa |
| 5,033,549 | A | 7/1991 | Champeaux et al. |
| 5,052,489 | A | 10/1991 | Carisella et al. |
| 5,070,768 | A | 12/1991 | Goncalves et al. |
| 5,070,788 | A | 12/1991 | Carisella et al. |
| 5,115,860 | A | 5/1992 | Champeaux et al. |
| 5,115,865 | A | 5/1992 | Carisella et al. |
| 5,159,145 | A | 10/1992 | Carisella et al. |
| 5,159,146 | A | 10/1992 | Carisella et al. |
| 5,240,077 | A | 8/1993 | Whitsitt |
| 5,320,182 | A | 6/1994 | Mendez |
| 5,392,856 | A | 2/1995 | Broussard, Jr. et al. |
| 5,392,860 | A | 2/1995 | Ross |
| 5,417,289 | A | 5/1995 | Carisella |
| 5,469,918 | A | 11/1995 | Haberman |
| 5,469,919 | A | 11/1995 | Carisella |
| 5,495,892 | A | 3/1996 | Carisella |
| 5,531,164 | A | 7/1996 | Mosley |
| 5,564,504 | A | 10/1996 | Carisella |
| 5,700,969 | A | 12/1997 | Mosley |
| 5,813,459 | A | 9/1998 | Carisella |
| 5,975,205 | A | 11/1999 | Carisella |
| 6,145,598 | A | 11/2000 | Carisella |
| 6,158,506 | A | 12/2000 | Carisella |
| 6,164,375 | A | 12/2000 | Carisella |
| 6,202,748 | B1 | 3/2001 | Carisella et al. |
| 6,213,217 | B1 | 4/2001 | Wilson et al. |
| 6,223,820 | B1 | 5/2001 | Carisella |
| 6,305,477 | B1 | 10/2001 | Carisella et al. |
| 6,311,778 | B1 | 11/2001 | Carisella et al. |
| 6,318,461 | B1 | 11/2001 | Carisella |
| 6,341,654 | B1 | 1/2002 | Wilson et al. |
| 6,345,669 | B1 | 2/2002 | Buyers et al. |
| 6,354,372 | B1 | 3/2002 | Carisella et al. |
| 6,374,917 | B2 | 4/2002 | Carisella |
| 6,458,233 | B2 | 10/2002 | Carisella |
| 6,543,541 | B2 | 4/2003 | Buyers et al. |
| 6,702,009 | B1 | 3/2004 | Drury et al. |
| 6,991,048 | B2 | 1/2006 | Zupanick |
| 7,000,705 | B2 | 2/2006 | Buyers et al. |
| 7,287,591 | B2 | 10/2007 | Campbell |
| 7,614,454 | B2 | 11/2009 | Buyers et al. |
| 7,690,429 | B2 | 4/2010 | Creel et al. |
| 7,703,511 | B2 | 4/2010 | Buyers et al. |
| 7,779,905 | B2 | 8/2010 | Carisella et al. |
| 7,891,424 | B2 | 2/2011 | Creel et al. |
| 7,950,468 | B2 | 5/2011 | Horton |
| 8,025,105 | B2 | 9/2011 | Templeton et al. |
| 8,113,282 | B2 | 2/2012 | Picou |
| 8,191,645 | B2 | 6/2012 | Carisella et al. |
| 8,534,367 | B2 | 9/2013 | Carisella |
| 8,757,278 | B2 | 6/2014 | Smithson |
| 8,813,841 | B2 | 8/2014 | Carisella |
| 9,062,543 | B1 | 6/2015 | Snider et al. |
| 9,080,405 | B2 | 7/2015 | Carisella |
| 9,476,272 | B2 | 10/2016 | Carisella et al. |
| 9,822,597 | B2 | 11/2017 | Carisella |
| 10,337,270 | B2 | 7/2019 | Carisella et al. |
| 10,337,323 | B2 | 7/2019 | Krüger et al. |
| 2001/0027868 | A1 | 10/2001 | Carisella |
| 2001/0035252 | A1 | 11/2001 | Carisella |
| 2004/0020709 | A1 | 2/2004 | Wilson et al. |
| 2004/0084190 | A1 | 5/2004 | Hill et al. |
| 2004/0108114 | A1 | 6/2004 | Lerche et al. |
| 2006/0102336 | A1 | 5/2006 | Campbell |
| 2007/0012435 | A1 | 1/2007 | Obrejanu |
| 2008/0196896 | A1 | 8/2008 | Bustos et al. |
| 2008/0202771 | A1 | 8/2008 | Carisella et al. |
| 2009/0095466 | A1 | 4/2009 | Obrejanu |
| 2010/0059233 | A1 | 3/2010 | Smithson et al. |
| 2010/0122814 | A1 | 5/2010 | Picou |
| 2010/0155054 | A1 | 6/2010 | Innes et al. |
| 2010/0186949 | A1 | 7/2010 | Xu et al. |
| 2010/0314135 | A1 | 12/2010 | Carisella et al. |
| 2011/0067854 | A1 | 3/2011 | Love et al. |
| 2011/0259607 | A1 | 10/2011 | Carisella |
| 2012/0006217 | A1 | 1/2012 | Anderson |
| 2012/0160483 | A1 | 6/2012 | Carisella |
| 2012/0247755 | A1 | 10/2012 | Colon et al. |
| 2012/0250208 | A1 | 10/2012 | Love et al. |
| 2012/0255842 | A1 | 10/2012 | Runkel |
| 2013/0327544 | A1 | 12/2013 | Carisella |
| 2014/0326465 | A1 | 11/2014 | Carisella |
| 2016/0040509 | A1 | 2/2016 | Castillo et al. |
| 2017/0175471 | A1 | 6/2017 | Boleyn, Jr. |
| 2017/0175472 | A1 | 6/2017 | Carisella et al. |
| 2018/0010619 | A1* | 1/2018 | Jaaskelainen ..... E21B 23/04 |
| 2018/0051534 | A1 | 2/2018 | El et al. |

OTHER PUBLICATIONS

HPI, Chapter 3, "Bailer Systems", High Pressure Integrity, Inc., 2008 Weatherford44 pages.

Imre I. Gazda and John J. Golfton, Halliburton Energy Services; A Battery-OperatedElectro-Mechanical Setting Tool for Use with Bridge Plugs and Similar Wellbore Tools; OTC 7877-1995; pp. 71-82.

Is.myhalliburton.com; Completion Tools, DPU Downhole Power Unit (Data Sheet) Nov. 21, 2005.

PCT Notification of Transmittal of International Search Report and the Written Opinion of the International Searching Authority dated Feb. 13, 2019, issued from the International Searching Authority in related PCT Application No. PCT/US2018/057388, (14 pages).

Petrowell Ltd.; Intervention Products—Motorised Setting Tool (MST); 2008.

Schlumberger Oilfield Glossary entry for "dump bailer", Accessed Jul. 23, 2013 via www.glossary.oilfield.slb.com.

Thru-Tubing Systems, et al.,Wireline Products Catalog, Revised Feb. 12, 2014, 44 pages.

* cited by examiner

DOWNHOLE PLACEMENT TOOL WITH FLUID ACTUATOR AND METHOD OF USING SAME

CROSS-REFERENCE TO RELATED APPLICATIONS

This application claims the benefit of U.S. Provisional Application No. 62/577,586 filed on Oct. 26, 2017 and U.S. Provisional Application No. 62/662,395 filed on Apr. 25, 2018, the entire content of which are hereby incorporated by reference herein.

BACKGROUND

The present disclosure relates generally to wellbore technology. More specifically, the present disclosure relates to downhole tools usable for placing materials in the wellbore.

Wellbores may be drilled to reach subsurface locations. Drilling rigs may be positioned about a wellsite, and a drilling tool advanced into subsurface formations to form the wellbore. During drilling, mud may be passed into the wellbore to line the wellbore and cool the drilling tool. Once the wellbore is drilled, the wellbore may be lined with casing and cement to complete the wellbore. Production equipment may then be positioned at the wellbore to draw subsurface fluids to the surface. Fluids may be pumped into the wellbore to treat the wellbore and to facilitate production.

In some cases, part or all of the wellsite may be plugged and/or sealed. For example, perforations may be drilled in a side of the wellbore to reach reservoirs surrounding the wellbore. Plugs may be inserted into the perforations to seal the wellbore from passage of fluid into the wellbore. Examples of plugs and/or plugging technology are provided in U.S. Pat. Nos. 9,062,543, 6,991,048, and 7,950,468, the entire contents of which are hereby incorporated by reference herein.

In some other cases, cementing tools may be deployed into the wellbore to drop cement into the wellbore to seal portions of the wellbore. Examples of cementing are provided in U.S. Pat. Nos. 5,033,549, 9,080,405, 9,476,272, 2014/0326465, and 2017/0175472, the entire contents of which are hereby incorporated by reference herein. The cement may also be used to seal materials in the wellbore.

Despite the advancements in wellbore technology, there remains a need for devices capable of effectively and efficiently placing materials in the wellbore. The present disclosure is directed at providing such needs.

SUMMARY

In at least one aspect, the disclosure relates to a downhole placement tool for placing a wellbore material in a wellbore. The downhole placement tool comprises an actuation assembly and a placement assembly. The actuation assembly comprises an actuation housing having a fluid pathway therethrough and an actuation piston seated in the actuation housing to block the fluid pathway. The actuation piston is movable by fluid applied thereto to open the fluid pathway and allow the fluid to pass through the fluid pathway. The placement assembly is connected to the actuation assembly, and comprises a placement housing having a pressure chamber to store the wellbore material therein; a door positioned in an outlet of the placement housing; and a placement piston. The placement piston is positioned in the placement housing, and comprises a piston head and a placement rod. The piston head is slidably movable in the placement housing. The placement rod is connected between the piston head and the door. The piston head is movable in response to flow of the fluid from the actuation assembly into the placement assembly to advance the placement piston and open the door whereby the wellbore material is selectively released into the wellbore.

The placement tool may have various features and/or combinations of features as set forth below:

The actuation assembly further comprises one of a ball actuator and an electro-hydraulic actuator. The actuation assembly further comprises a support positioned in the actuation housing and wherein the actuation piston comprises a disc removably seated in an opening in the support. The actuation assembly further comprises a rupture disc positioned in the actuation housing and wherein the actuation piston comprises a piercing rod having a tip extendable through the rupture disc. The downhole placement tool further comprises a deflection plate between the actuation assembly and the placement assembly. The actuation assembly further comprises a filtration or a plug sub. The actuation assembly further comprises a sub with the fluid pathway extending therethrough, and the actuation piston has tabs at a downhole end thereof positionable against the sub to define a fluid gap therebetween. The downhole placement tool further comprises shear pins releasably positioned about the actuation piston, the placement housing, the support, the actuation housing, the door, and/or the placement rod. The downhole placement tool further comprises filters positionable in the fluid pathway.

The downhole placement tool further comprises a crossover sub connecting the actuation assembly to the placement assembly. The placement assembly further comprises a metering sub with channels for passing fluid from the actuation assembly into the pressure chamber. The downhole placement tool further comprises a perforated sleeve with a hole to receive the placement rod therethrough. The placement rod comprises a piston rod and a push rod. The piston rod is connected to the piston head and movable therewith, and the push rod is connected to the door and has a hole to slidingly receive an end of the piston rod. The downhole placement tool further comprises a valve positioned about the push rod to selectively permit fluid to pass into the push rod. The downhole placement tool further comprises a disc supported in the pressure chamber, the placement rod extending through the disc. The downhole placement tool further comprises a peripheral screen slidingly positionable in the placement housing. The peripheral screen comprises a plate with a hole to receive the placement rod therethrough and a tubular screen, the tubular screen extending from the plate. The wellbore material comprises bentonite. The pressure chamber is shaped to receive the wellbore material having a spherical shape, a disc shape, a box shape, a fluted shape, a cylindrical shape, and/or combinations thereof. The wellbore material has a cylindrical body with peripheral cuts extending from a periphery towards a center thereof, the cuts shaped to permit passage of the fluid therein.

In another aspect, the disclosure relates to a method of placing a wellbore material in a wellbore. The method comprises placing a wellbore material in a pressure chamber of a placement tool; deploying the placement tool into the wellbore; and releasing the wellbore material into the wellbore by: pumping fluid from a surface location into the placement tool to unblock a blocked fluid pathway to the pressure chamber; and allowing the fluid to pass from the fluid pathway and into the pressure chamber to increase a pressure in the pressure chamber sufficient to open a door of the pressure chamber.

The method further comprises triggering the fluid to flow from the surface location and into the fluid pathway. The pumping comprises creating an opening in the fluid pathway by unseating a placement piston from a support in the fluid pathway. The pumping comprises creating an opening in the fluid pathway by driving a piercing piston through a rupture disc. The releasing comprises deflecting the fluid as it passes into the pressure chamber. The releasing comprises opening the door by applying pressure from the fluid to a placement piston connected to the door.

Finally, in another aspect, the disclosure relates to a method of placing a wellbore material in a wellbore. The method comprises placing a wellbore material in a pressure chamber of a placement tool; deploying the placement tool into the wellbore; opening a fluid pathway to the pressure chamber by pumping fluid from a surface location and into the deployed placement tool; and releasing the wellbore material into the wellbore by passing the fluid through the fluid pathway and into the pressure chamber until a pressure in the pressure chamber is sufficient to open a door to the pressure chamber.

The method further comprises fluidizing the wellbore material by adding fluid to the pressure chamber after the placing and before the deploying. The method further comprises activating the wellbore fluid by exposing a core of the wellbore material to a wellbore fluid in the wellbore. The activating comprises dropping the wellbore fluid a distance in the wellbore sufficient to wash away a coating of the wellbore material and expose the core to the wellbore material. The deploying comprises deploying the placement tool to a depth a distance above a sealing location, and the method further comprises activating the wellbore material by dropping the wellbore material through the wellbore and allowing wellbore fluid in the wellbore to wash away a coating of the wellbore material as the wellbore material falls through the wellbore.

This summary is not intended to be limiting of the subject matter herein.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. The appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

Figure 1:
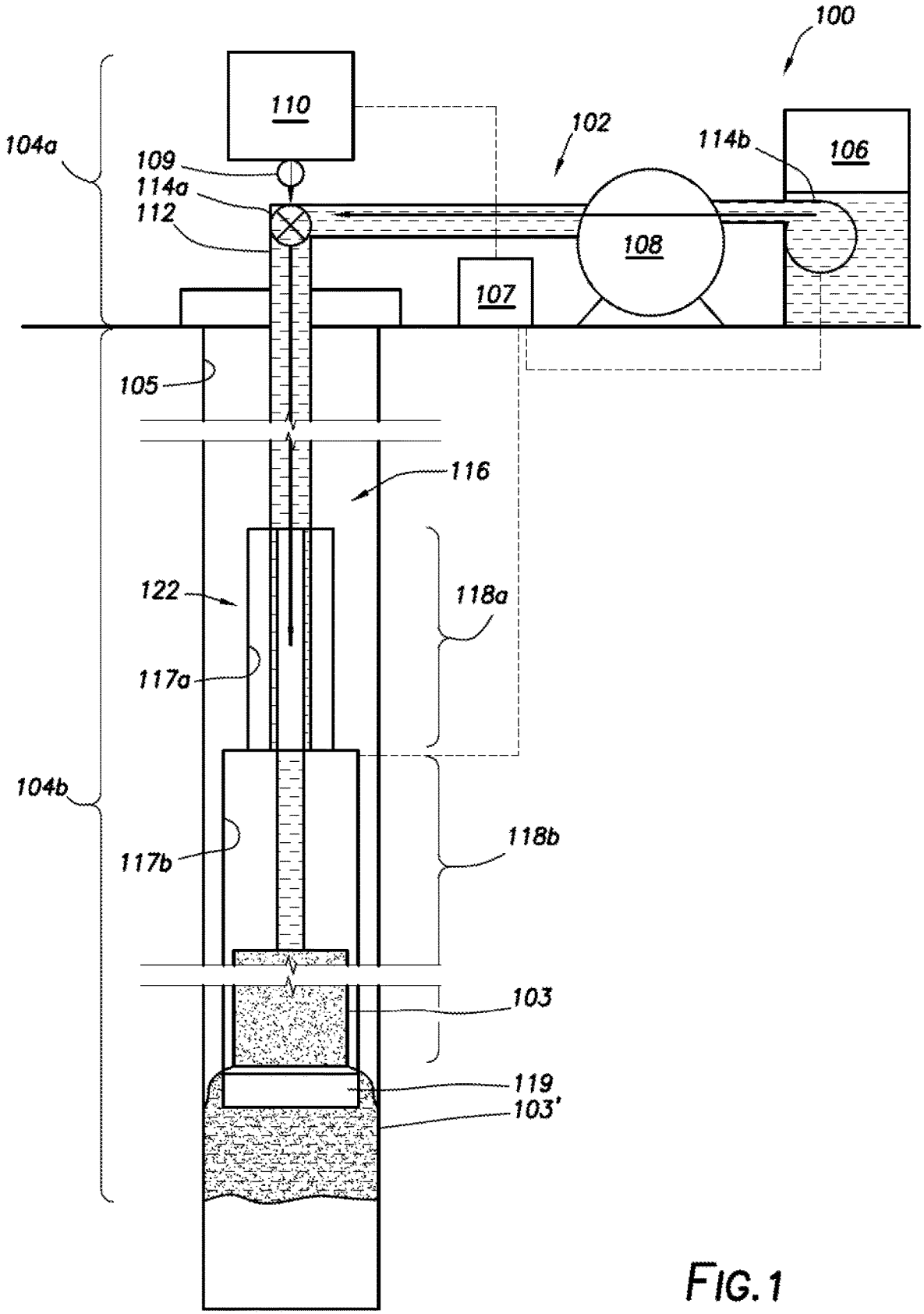
FIG. 1 is a schematic diagram depicting a wellsite with a downhole placement tool with fluid actuator deployed into a wellbore.

The description that follows includes exemplary apparatus, methods, techniques, and/or instruction sequences that embody techniques of the present subject matter. However, it is understood that the described embodiments may be practiced without these specific details.

The present disclosure relates to a downhole placement tool for placing a wellbore material in a wellbore. The downhole placement tool has an actuation assembly with a fluid chamber coupled to a fluid source, and a placement assembly with a pressure chamber having the wellbore material therein. The placement tool may be triggered from a surface location to pass fluid from the fluid chamber into the pressure chamber. Once triggered, the downhole tool may be actuated by the fluid pressure to release fluid from the fluid chamber into the pressure chamber, and to open a door to release the wellbore material into the wellbore. The pressure chamber may remain dry, sealed, and isolated from external pressure (e.g., remain at atmospheric pressure) to protect the wellbore material until the placement tool is actuated. The wellbore material may be a solid and/or liquid usable in the wellbore, such as a sealant (e.g., bentonite), polymer, mud, acid, pellets, sand, blocks, epoxy, and/or other material. The wellbore material may be a material that reacts with the fluid to perform a wellbore function, such as sealing the wellbore, when released into the wellbore.

The placement tool may be provided with a trigger, the actuation assembly, a fluid actuator, pistons, valves, and/or other devices to manipulate the flow of fluid and/or the release of the wellbore material into the placement assembly and/or the wellbore. These mechanisms may be used to provide a pressure driven system that releases the wellbore material once a given pressure is achieved and sufficient force is generated to open the door. The placement tool may be capable of one or more of the following: surface actuation, pressure balanced operation, pressure dampening, protection of wellbore materials prior to release, dry isolation of wellbore materials until needed, premixing of the wellbore materials for timed and/or controlled operation, operability in harsh (e.g., high pressure) environments, remote and/or pressure driven actuation, positionable placement of the wellbore materials, selective release of the wellbore materials, integration with existing wellsite equipment (e.g., coiled tubing, drill pipe, and/or other conveyances), preventing and/or releasing stuck in hole tools, and/or other features.

The placement tool and operations herein may be used to optimize sealing and isolation of materials, such as nuclear waste. Wells may be abandoned by using a wellbore material that is a flexible cement capable of sealing the wellbore, such as bentonite. The wellbore material may be hydrated to allow it to be flexible and work like modeling clay. In the wellbore, the wellbore material may retain water, stay hydrated, and flow to shift and reshape with changes in the wellbore. The wellbore material then may be secured in place to act as an isolation barrier. The wellbore material is designed to provide a pressure barrier that, when properly placed, can be an isolation barrier to protect for extended periods of time.

The wellbore material is intended to address wellbore issues, such as geologic shifting, hole deformation, microcracks, micro-fissures, or de-bonding of cement from casing (thermal retrogression) which may cause failures. In an example, some wells may be subject to casing pressure, such as gaseous pressure between annuli of wells that need to be permanently abandoned. After wells are abandoned, pressure pockets of natural gas blow may cause migration of gas from microcracks to the surface. The flexible wellbore material (e.g., bentonite with a flexible cement) may be used to abate sustained casing pressure and prevent migration of gas up the wells. In another example, fracturing of the wellbore can cause radial cracks that radiate upward along casing and cement with conventional cement. The flexible wellbore material may be used to prevent cracking. The flexible wellbore material may also be used to hydrate through the annulus. The flexible wellbore material may be placed in an effort to assist with these and other downhole issues.

FIG. 1 is a schematic diagram of a wellsite 100 with a downhole placement system 102 for placing a wellbore material 103 in a wellbore 105. The downhole placement system 102 includes surface equipment 104*a* and subsurface equipment 104*b* positioned about the wellbore 105. The wellsite 100 may be equipped with gauges, monitors, controllers, and other devices capable of monitoring, communicating, and or controlling operations at the wellsite 100.

The surface equipment 104*a* includes a fluid source 106, a conveyance support (e.g., coiled tubing reel) 108, a conveyance 112, a trigger 110, and a surface unit 107. The fluid source 106 may be a tank or other container to provide fluid to the wellsite 100. The fluid may be any fluid usable in the wellbore 105, such as water, drilling, injection, treatment, fracturing, acidizing, hydraulic, additive, and/or other fluid. The fluid may have solids, such as sand, pellets, or other solids therein. The fluid may be selected for its ability to flow through the conveyance 112 and into the wellbore 105, for its ability to react with the wellbore material 103 and/or for its ability to perform specified functions in the wellbore 105.

The fluid is pumped from the fluid source 106 through the conveyance 112 and into the wellbore 105. The conveyance 112 may be any carrier capable of passing fluid into the wellbore 105, such as a coiled tubing, drill pipe, slickline, pipe stem, and/or other fluid carrier. The conveyance 112 may be supported from the surface by a support, such as a coiled tubing reel 108 as shown, or by other structure, such as a rig, crane, and/or other support. Fluid control devices, such as valve 114*a* and pump 114*b* may be provided to manipulate flow of the fluid through the conveyance 112 and into the wellbore 105.

The trigger 110 may be a device capable of sending a signal to a downhole placement tool 116 for operation therewith. The trigger 110 may be, for example, a ball dropper designed to selectively release a ball 109 into the conveyance 112 as shown. The trigger 110 may also be an electronic device capable of sending an electrical signal through the conveyance 112 and to the placement tool 116. The trigger 110 may be manually or automatically operated. At least a portion of the trigger 110 may be coupled to or included in the placement tool 116. For example, the placement tool 116 may include devices to receive a ball, a signal, or other triggers from the surface as described further herein.

The surface unit 107 may be positioned at the surface for operating various equipment at the wellsite 100, such as the fluid source 106, the valve 114*a*, the pump 114*b*, the surface trigger (e.g., ball dropper) 110, and the placement tool 116. Communication links may be provided as indicated by the dashed lines for passage of data, power, and/or control signals between the surface unit 107 and various components about the wellsite 100.

The subsurface equipment 104*b* includes the downhole placement tool 116 suspended from the conveyance 112. The downhole placement tool 116 includes an actuation portion (assembly) 118*a* and a placement portion (assembly) 118*b*. The actuation portion 118*a* may be a cylindrical structure with a fluid chamber 117*a* therein capable of receiving fluid from the conveyance 112. The placement portion 118*b* may also be a cylindrical structure with a pressure chamber 117*b* therein capable of storing the wellbore material 103 therein. The placement portion 118*b* may have a door 119 to selectively release the wellbore material 103. The door is shown as a rounded shaped item, but may be any shape, such as cylindrical or other shape.

The placement portion 118*b* is fluidly isolated from the actuation portion 118*a* by an actuation assembly 122. The actuation assembly 122 may be triggered by the trigger 110 to release the fluid from the actuation portion 118*a* to the placement portion 118*b*, and to selectively open the door 119 in the placement portion 118*b*, and to release the wellbore material 103 into the wellbore 105 as is described further herein.

Once the fluid passes into the pressure chamber 117*b*, it invades (e.g., surrounds or is exposed to) the wellbore material 103. The wellbore material 103 may be any material usable in the wellbore 105, such as a sealant, polymer, mud, acid, pellets, sand, blocks, epoxy, settling agent, and/or other material, capable of performing functions in the wellbore 105. Upon contact with the fluid (or within a given delay time after exposure to the fluid), the wellbore material 103 may react to the fluid and form a mixture 103'. After the fluid passes into the pressure chamber 117*b*, a door 119 may open to allow the wellbore material 103 and/or the mixture 103' to exit the placement tool 116 and enter the wellbore 105 as is described further herein.

Figure 2A:
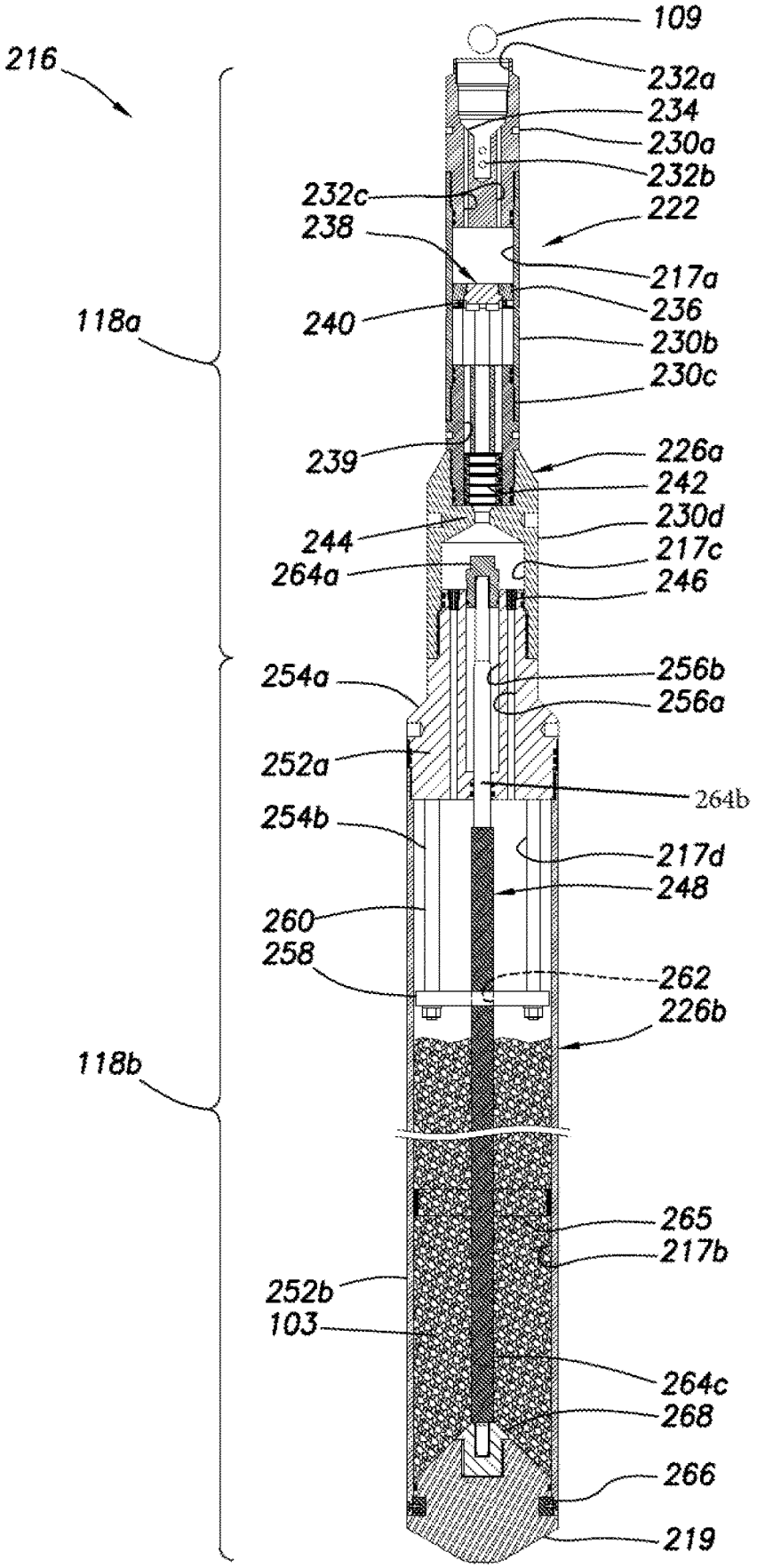
FIGS. 2A and 2B are cross-sectional and exploded views, respectively, of an example downhole placement tool with a pellet wellbore material stored therein.
Figure 2B:
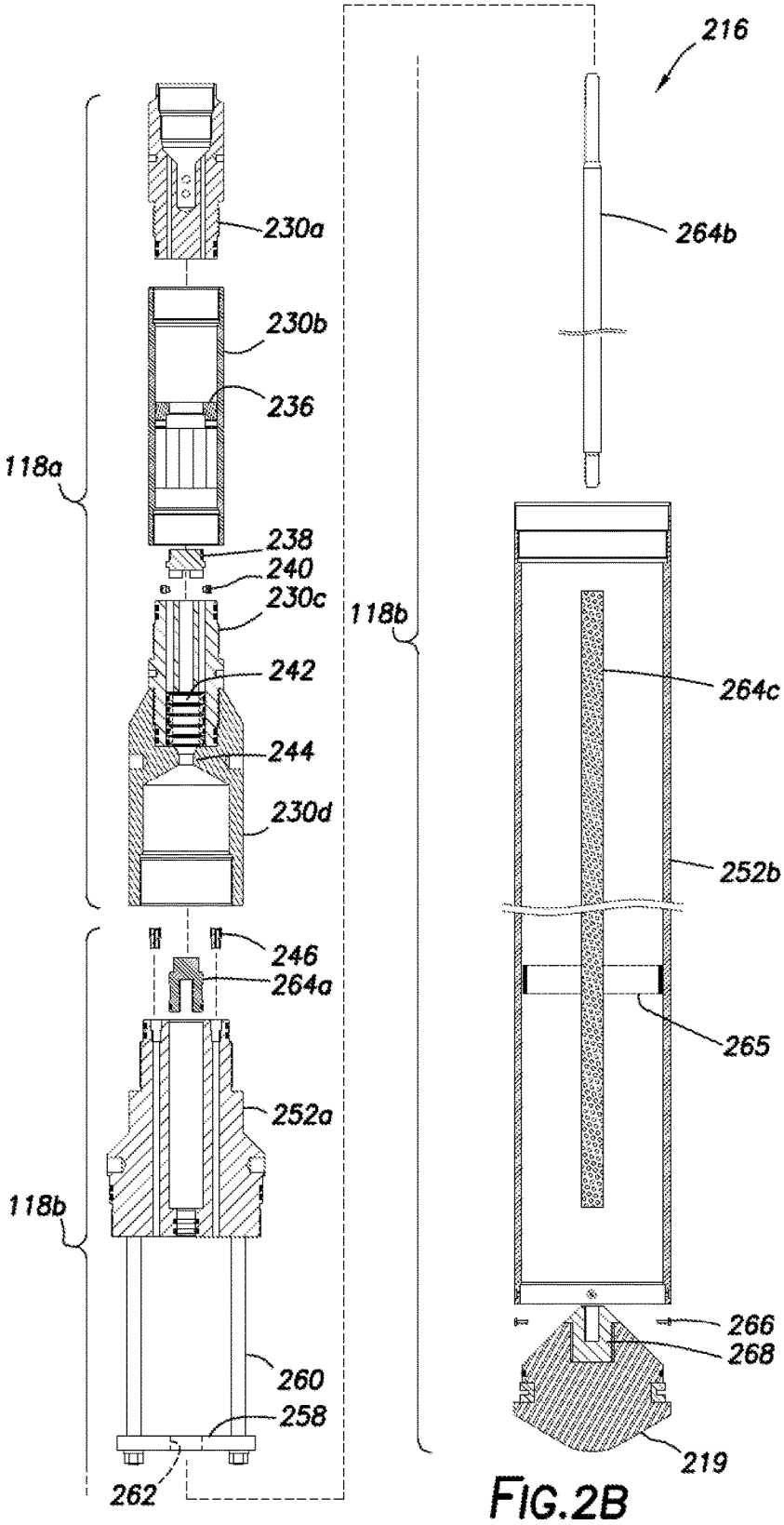

FIGS. 2A-2B show an example ball actuated placement tool 216. This version includes an actuation portion 118*a*, a placement portion 118*b*, and an actuation assembly 222. The actuation portion 118*a* is triggered by the ball 109. The actuation portion 118*a* includes an actuator housing 226*a* with the fluid chamber 217*a* therein. The housing 226*a* may be a modular member including a series of threadedly connected subs, collars, sleeves, and/or other components. In this version, the housing 226*a* includes a circulation sub 230*a*, a piston collar 230*b*, a filtration sub 230*c*, and an actuator crossover 230*d*.

The circulation sub 230*a* has a fluid inlet 232*a* connectable to the conveyance (e.g., 112 of FIG. 1) to receive the fluid therefrom, and an exit port 232*b* to release the fluid into the wellbore 105. The circulation sub 230*a* also has fluid passageways 232*c* for passing at least a portion of the fluid into the fluid chamber 217*a*.

The circulation sub 230*a* has a ball seat 234 positioned between the inlet 232*a* and the exit port 232*b*. The ball seat 234 is shaped to sealingly receive the ball 109. Once seated in the ball seat 234, the ball 109 closes the exit port 232*b* to prevent fluid from exiting therethrough. With the ball 109 seated, the fluid previously exiting the exit port 232*b* now passes through fluid passageways 232*c* and into the fluid chamber 217*a* with the other fluid entering the circulation sub 230*a* through the fluid inlet 232*a*.

The piston collar 230*b* may be a tubular sleeve located between the circulation sub 230*a* and the filtration sub 230*c*, and is threadedly thereto. The piston collar 230*b* may have ends shaped to receive portions of the circulation and filtration subs 230*a,c*. The piston collar 230*a* has a support 236 along an inner surface thereof a distance downhole from the circulation sub 230*a*. The support 236 may have a circular inner periphery shaped to receive a shear piston 238.

The shear piston 238 may be a disc shaped member removably seated in the support 236 by shear pins (or screws) 240. The shear piston 238 and support 236 may define a fluid barrier to fluidly isolate the fluid in the fluid chamber 217*a* entering the placement portion 118*b*. Once sufficient force (e.g., pressure) is applied to the shear pins 240, the shear piston 238 may be released to allow the fluid to pass from the fluid chamber 217*a* and into the placement portion 118*b* as is described further herein.

The filtration sub 230*c* is positioned between the piston collar 230*b* and the actuator crossover 230*d*. The filtration sub 230*c* may be a tubular member in fluid communication with the fluid chamber 217*a* once the shear piston 238 is released. The filtration sub 230*c* has a fluid passage 239 therethrough that reduces in cross-sectional area to slow the flow of fluid as it passes therethrough.

The filtration sub 230*c* may have one or more filters 242 positioned along the tapered fluid passage 239 defined within the filtration sub 230*c*. One or more filters 242 may be positioned (e.g., stacked) inside the filtration sub 230*c* to filter the fluid as it passes from the fluid chamber 217*a* and into the placement portion 118*b*. The filters 242 may be conventional filters capable of removing solids, debris, or other contaminants from the fluid passing therethrough. The filters 242 may be configured from fine to course filtration by selectively defining mesh or other filtration components therein.

The actuator crossover 230*d* is threadedly connected between the filtration sub 230*c* and the placement portion 118*b*. The actuator crossover 230*d* has a tapered outer surface with an outer diameter that increases to transition from an outer diameter of the filtration sub 230*c* to an outer diameter of an uphole end of the placement portion 118*b*. The actuator crossover 230*d* has a tubular inner surface that is shaped to receive the filtration sub 230*c* at one end and the uphole end of the placement portion 118*b* at the other end, with a fluid restriction 244 defined therebetween. The fluid restriction 244 is positioned adjacent an outlet of the fluid passage 239 of the filtration and the filters 242 to receive the filtered fluid therethrough.

The placement portion 118*b* is threadedly connected to a downhole end of the actuation portion 118*a* adjacent the actuator crossover 230*d* with an actuation chamber 217*c* defined therein. The placement portion 118*b* includes a placement housing 226*b*, metering jets (or valves) 246, and a push down piston 248. The housing 226*b* includes a metering sub 252*a*, a placement sleeve 252*b*, and the door 219, with the pressure chamber 217*b* defined therein.

The metering sub 252*a* is threadedly connected between the actuator crossover 230*d* and the placement sleeve 252*b*. The metering sub 252*a* includes a piston portion 254*a* and a passage portion 254*b*. The piston portion 254*a* has an uphole end threadedly connectable to the actuator crossover 230*d* and is receivable therein. The piston portion 254*a* also has a downhole end threadedly connected to the placement sleeve 252*b* and extending therein. The piston portion 254*a* has an outer surface between the uphole and downhole ends that is shaped to increase from an outer diameter of the actuator crossover 230*d* to an outer diameter of the placement sleeve 252*b*.

The piston portion 254*a* of the metering sub 252*a* is a solid member with metering passages 256*a* and a piston passage 256*b* extending therethrough. The metering jets 246 are positioned in the metering passages 256*a* to selectively allow the filtered fluid in the actuation chamber 217*c* to pass therethrough. The metering jets 246 may be selected to alter (e.g., reduce) flow of the fluid passing through the metering passages 256*a* and into the passage portion 256*b*.

The passage portion 254*b* includes a passage plate 258 supported from the piston portion 254*a* by long bolts 260. A dry plate chamber 217*d* is defined between the passage plate 258 and the metering sub 252*a*. The passage plate 258 has a hole 262 to receive the piston 248 and permit passage of fluid therethrough. The holes 262 may be defined to allow fluid to pass at a selected (e.g., reduced) rate.

The push down piston 248 extends through the metering sub 252*a* and the placement sleeve 252*b*. The push down piston 248 includes a piston head 264*a*, a push rod 264*b*, and a tube sleeve (screen) 264*c*. The piston head 264*a* extends from an uphole end of the push down piston 248 and into the actuation chamber 217*c*. The push rod 264*b* is connected to the piston head 264*a* at an uphole end and the door 219 at a downhole end.

Figure 3A:
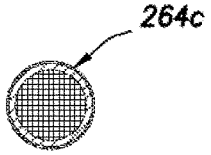
FIGS. 3A and 3B are end views of a perforated tube sleeve and a centralizer, respectively, of the downhole placement tool of FIG. 2A.
Figure 3B:
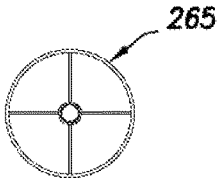

The push rod 264*b* may be provided with various options. For example, the tube sleeve 264*c* extends about a downhole portion of the push rod 264*b*, and has perforations for the passage of the fluid therethrough. An end view of the push rod 264*b* and the tube sleeve 264*c* is shown in greater detail in FIG. 3A. In another example, a centralizer 265 may be positioned in the placement sleeve 252*b*. The push rod 264*b* passes through the centralizer 265 and is slidingly supported centrally therein. As shown in greater detail in FIG. 3B, the centralizer 265 may have a central hub to slidingly receive the push rod 264*b*, and spokes connected to an outer ring to support the hub and the push rod 264*b* centrally within the placement sleeve 252*b*.

Referring back to FIGS. 2A and 2B, the door 219 may be provided with a receptacle (or connector) 268 for receivingly connecting to the downhole end of the push rod 264*b*. The door 219 is removably secured to a downhole end of the placement sleeve 252*b* by shear pins 266. The pressure chamber 217*b* is defined between the door 219 and the metering sub 252*a* to house the wellbore material 103. The push rod 264*b* is slidably positionable through the metering sub 252*a* in response to fluid forces applied to the piston head 264*a* and/or the forces applied to the door 219 to selectively release the wellbore material 103 as is described further herein.

During operation, the fluid from the surface passes through fluid passageways 232*c*, 239, 256*a* and the various fluid chambers within the placement tool 216. These passageways and chambers define a fluid pathway through the placement tool 216. Various devices along these passageways, such as the piston (disc) 238 and support 236, form the actuation assembly 222 that selectively releases the fluid through the actuation portion 118*a* and into the placement portion 118*b* to cause the door 119 to open and release the wellbore material 103.

Figure 4A:
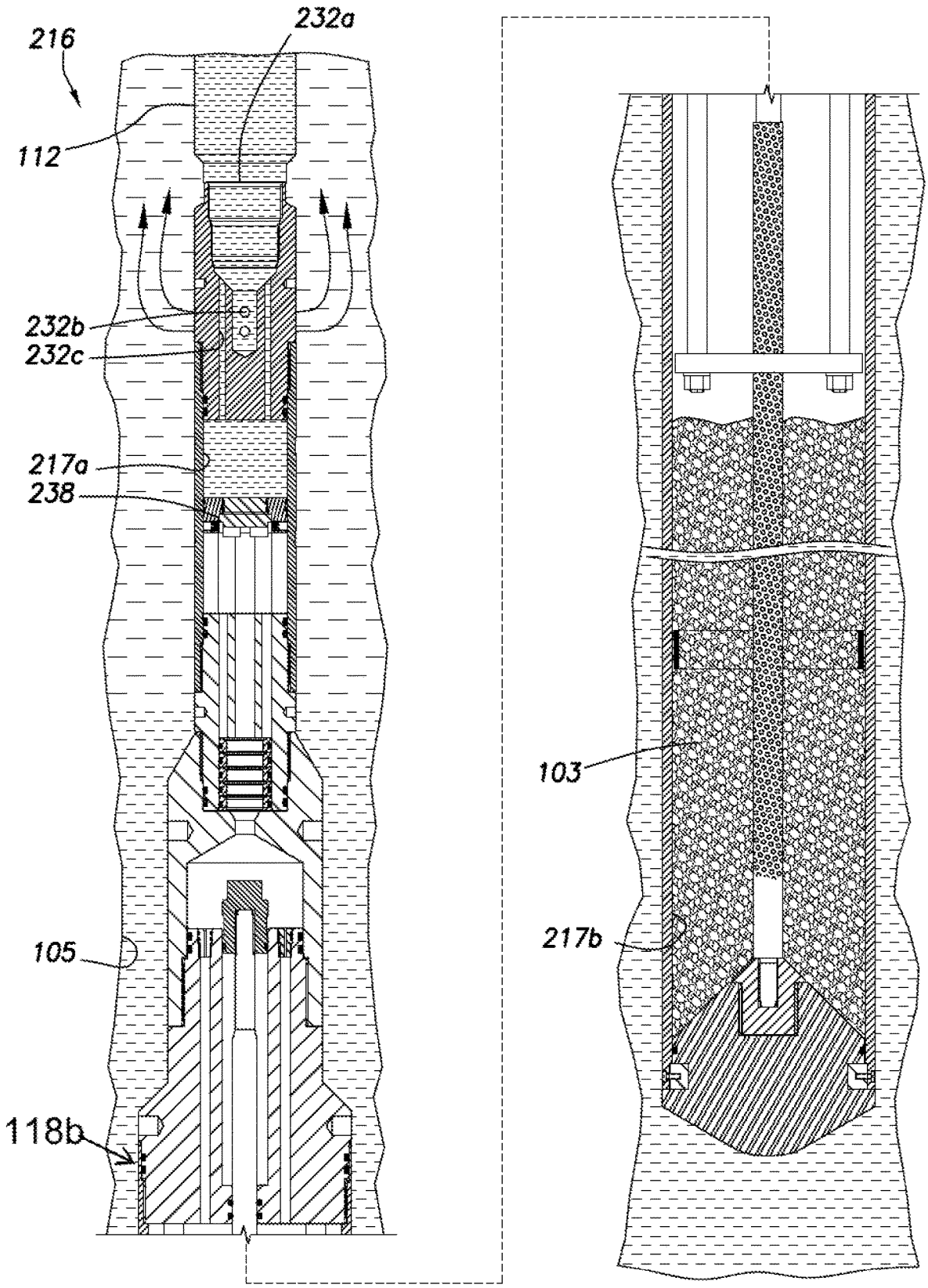
FIGS. 4A-4C are partial cross-sectional views of the downhole placement tool of FIG. 2A in a run-in mode, an actuated mode, and a placement mode, respectively.
Figure 4B:
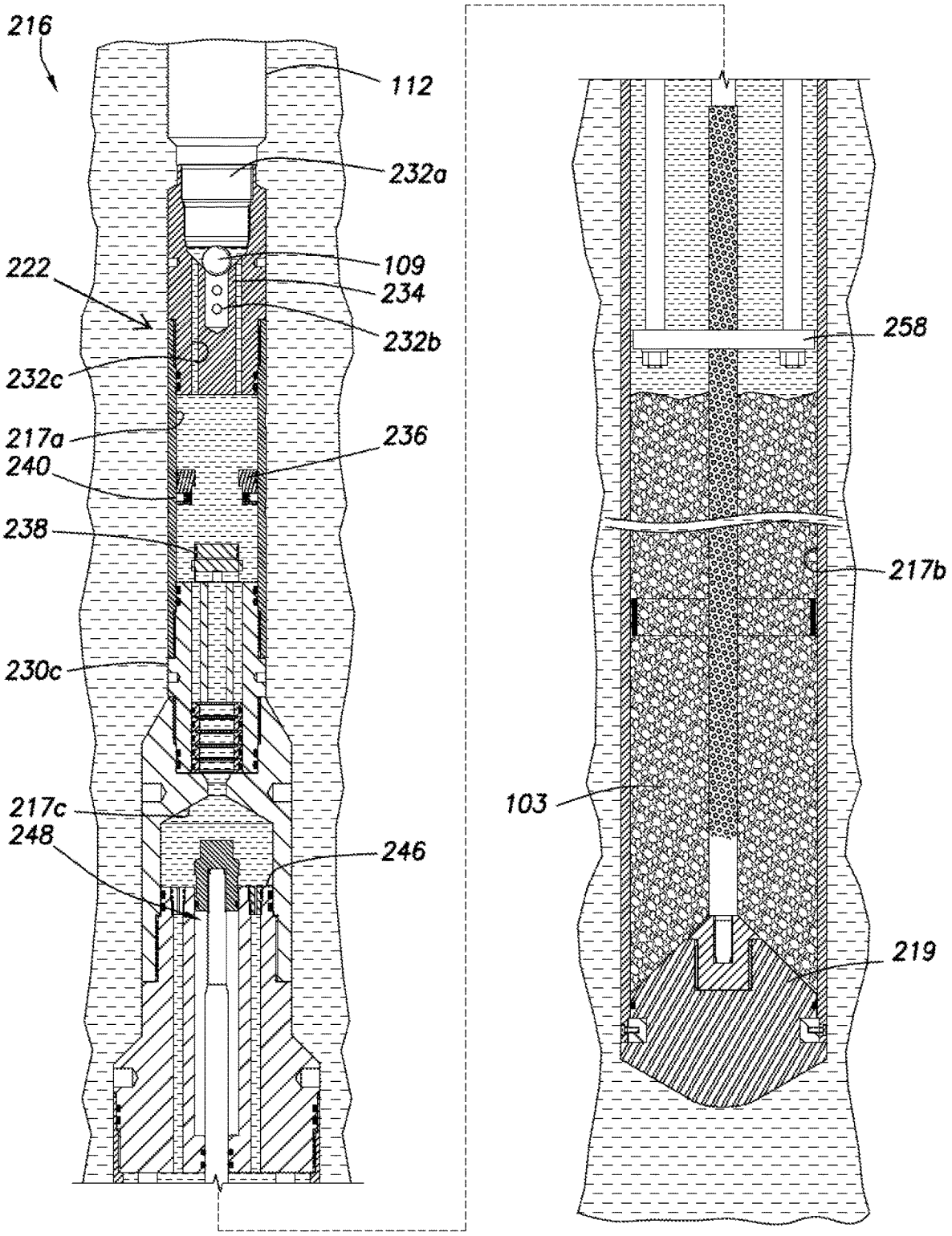
Figure 4C:
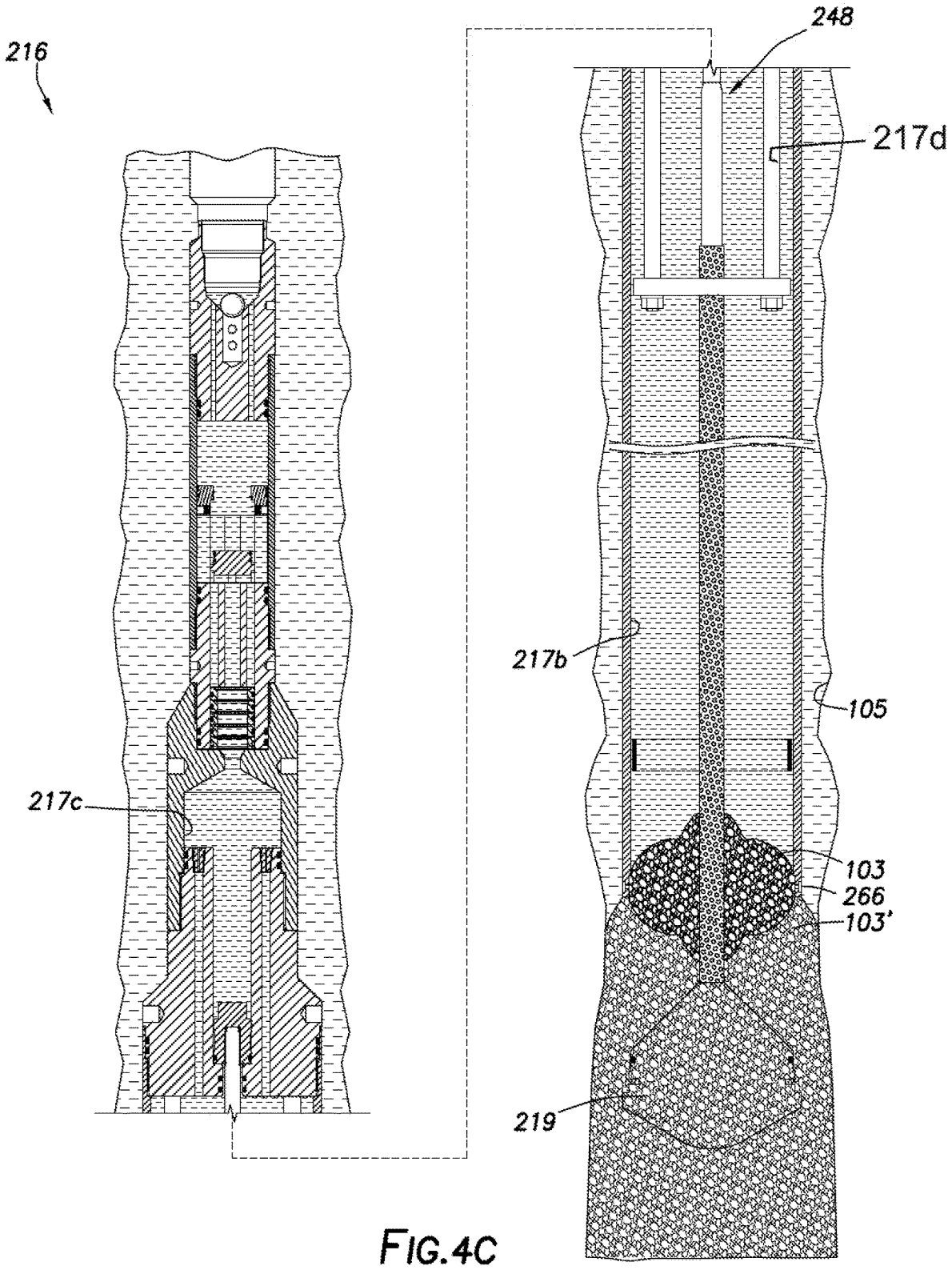

FIGS. 4A-4C show operation of the ball actuated placement tool 216. These figures show the placement tool 216 in a run-in mode, an actuated mode, and a placement mode, respectively. In the run-in mode of FIG. 4A, the placement tool 216 is positioned in the wellbore 105 to a given depth. The fluid from the fluid source 106 (FIG. 1) is pumped via the conveyance 112 into the inlet 232*a*. A portion of this fluid passes through the fluid passageways 232*c* and into the fluid chamber 217*a*. A remaining portion of this fluid passes out exit port 232*b* and into the wellbore 105 as indicated by the curved arrows. In this position, the fluid in fluid chamber 217*a* is insufficient to shear the shear piston 238. The fluid is, therefore, unable to pass into the placement portion 118*b*, and the wellbore material 103 in the pressure chamber 217*b* remains dry and protected.

In the actuated mode of FIG. 4B, the ball 109 has been released through the conveyance 112 and seated in the ball seat 234 to trigger actuation of the actuation assembly 222. Once seated, the ball 109 blocks the exit port 232*b*, thereby forcing all fluid entering inlet 232*a* to pass through the fluid passageways 232*c* and into the fluid chamber 217*a*. The increase in fluid causes sufficient force to shear the shear pins 240 and release the shear piston 238 from the support 236. With the shear piston 238 released, the fluid in fluid chamber 217*a* is free to pass through the filtration sub 230*c* for filtering, and into the actuation chamber 217*c*.

The filtered fluid in the actuation chamber 217*c* passes through metering jets 246 and the passage plate 258, and into the pressure chamber 217*b*. The configuration of the inlets, passages, passageways, valves, plate, and other fluid channels through the placement tool 216 may be shaped to manipulate (e.g., reduce) flow of the fluid into the pressure chamber 217*b* to prevent damage to the wellbore material 103 which may occur from hard impact of fluid hitting the wellbore material 103. At this point, the fluid pressure in the actuation chamber 217*c* is insufficient to move the piston 248 and/or open the door 219. The wellbore material 103 has been invaded (e.g., surrounded) by the fluid, but has not yet reacted. The wellbore material 103 may be configured to react after a delay to allow the wellbore material 103 to release before reaction.

In the placement mode of FIG. 4C, the pressure in actuation chamber 217*c* has increased and/or the fluid in the pressure chamber 217*b* has increased to an actuation level sufficient to drive the piston 248 downhole. The forces applied to the piston 248 by the fluid in the chambers 217*c,b* is sufficient to cause the piston 248 to shift downhole and to shear the shear pins 266 attached to the door 219. In this position, the door 219 opens and releases the invaded wellbore material 103 into the wellbore 105.

The invaded wellbore material 103 may be selected such that it reacts after leaving the placement tool 216. For example, the wellbore material 103 may be a material reactive to water passing into the pressure chamber 217*b*. To prevent the material from sticking within the placement tool 216, the reaction may be delayed such that the wellbore material 103 reacts with the fluid in the wellbore 105 to form the wellbore mixture (or fluidized or hydrolized wellbore material) 103', such as a sealant capable of sealing a portion of the wellbore 105. In at least some cases, the sealant may be used to sealingly enclosed items (e.g., hazardous material) at a subsurface location. The process may be repeated to allow for layers of sealant to be applied to secure such items in place.

In an example operation for placing a sealant as the wellbore material 103 in the wellbore 105, the placement tool 216 may be deployed into the wellbore 105 by the conveyance 112. The placement tool 216 may be positioned at a desired location in the wellbore, such as about 10 feet (3.05 m) above a location for performing a wellbore operation. The ball 109 may be placed in the conveyance 112, and fall to its position in the seat 234. As fluid pumps through the conveyance 112, a pressure in the chamber 217*a* increases until the shear pins 240 shear and release the shear piston 238. The fluid is at a pressure of about 3,000 psig (206.84 Bar) as it is now free to rush through the filtration sub 230*c* and into the actuation chamber 217*c*.

The fluid in the actuation chamber 217*c* flows through the metering jets 246. The metering jets 246 slow down the volume and rate of advancement of the fluid as it passes into the dry plate chamber 217*d*. The fluid fills the plate chamber 217*d* and passes through an annular gap between the push rod 264*b* and the tube sleeve 264*c*. As the fluid passes through the annular gap, the fluid also flows to a top of the door 219 and radially into the pressure chamber 217*b*. The fluid floods the pressure chamber 217*b* in about 60 seconds. This flooding may occur with a minimal pressure drop or compressive forces applied to the wellbore material 103.

The pressure in the pressure chamber 217*b* increases until it reaches equilibrium, namely when the pressure in the pressure chamber 217*b* equals the pressure of the conveyance and the wellbore pressure at the placement depth. The placement tool 216 may be provided with pressure balancing to isolate chambers 217*a-c* from external pressures before release of the wellbore material 103 (e.g., sealant). During this time, the fluid in the fluid chambers 217*a* may be maintained at 1 atm psia (atmospheric pressure) (6.89 kPa), and fluid in the pressure chambers 217*b* may be maintained at 1 atm psig (108.22 kPa) (gauge pressure).

While in equilibrium, the push piston 248 pushes the push rod against the door 219. This force eventually shears the shear pins 266 and releases the door. The door 219 pushes about 6 inches (15.24 cm) out of the placement tool and separates from the push rod 264*b*. With the door 219 open, the wellbore material 103 falls into the wellbore 105, disperses, and collects atop its intended platform. The wellbore material 103 may react (e.g., swell) after exposure to wellbore fluid in the wellbore 105.

Figure 5:
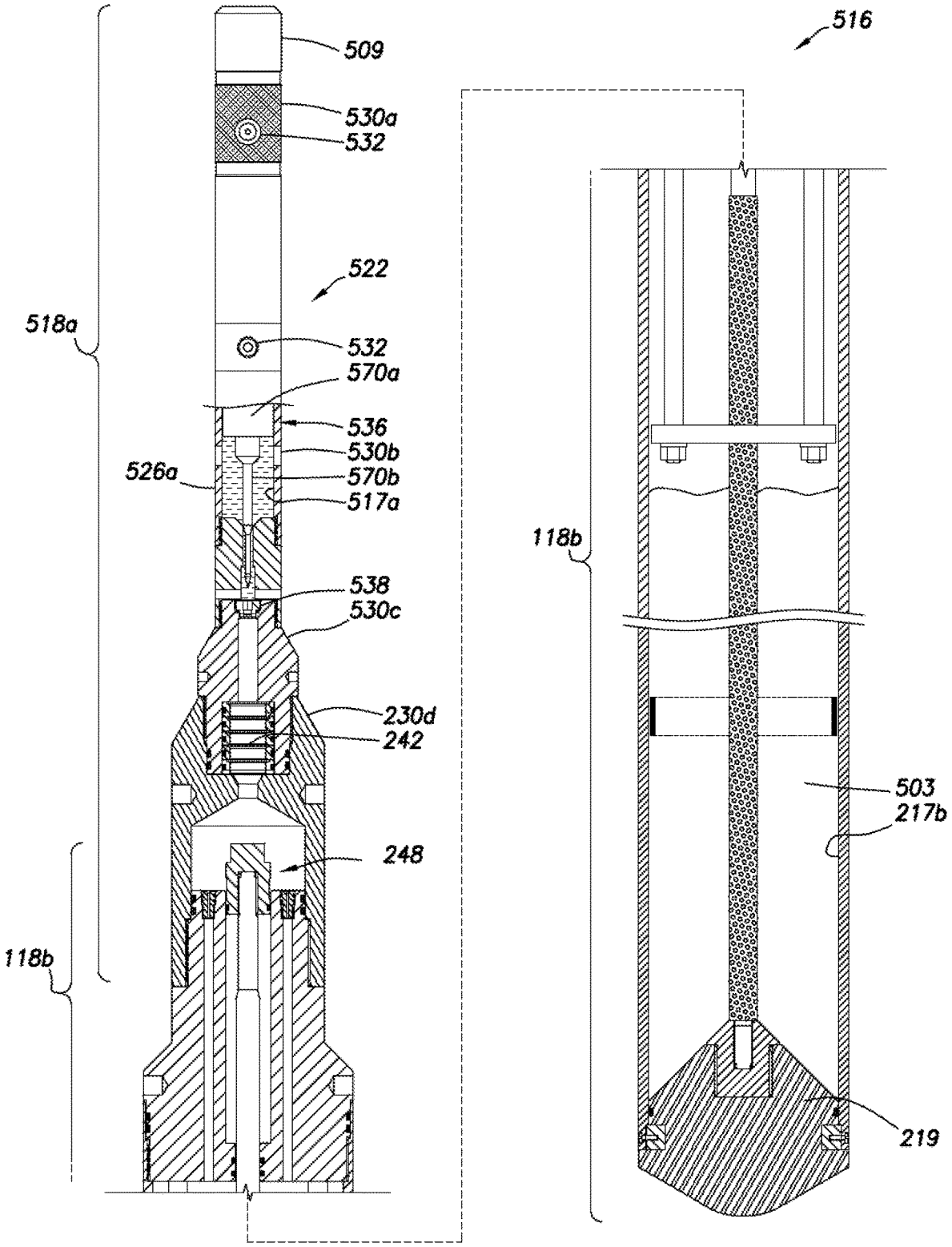
FIG. 5 is a partial cross-sectional view of an electro-hydraulic placement tool, and a sand wellbore material stored therein.

FIG. 5 show an example electro-hydraulic placement tool 516. The placement tool 516 includes an actuation portion 518*a*, the placement portion 118*b*, and an actuator 522. In this version, the actuation portion 518*a* is triggered by an electro-hydraulic signal from the surface. The actuation portion 518*a* includes a housing 526*a* with the fluid chamber 517*a* therein. The housing 526*a* includes a trigger sub 530*a*, a tandem sub 530*b*, a filtration sub 530*c*, and the actuator crossover 230*d*.

The trigger sub 530*a* may be a cylindrical member with an upper portion electrically connectable to the conveyance (e.g., a wireline 112 not shown). The trigger sub 530*a* includes a transceiver 509, hydraulic plugs 532, and the fluid chamber 517*a*. The transceiver 509 may be an electrical communication device capable of communication with the trigger 110 (FIG. 1) for passing signals therebetween. The transceiver 509 may be wired via the conveyance 112 and/or wirelessly connected to the trigger 110 for receiving an actuation signal therefrom. The trigger sub 530*a* may have the fluid chamber 517*a* therein and the hydraulic plugs 532 extending therethrough. The fluid chamber 517*a* may receive wellbore fluid from the wellbore 105 via holes in the tandem sub 530*b*.

The tandem sub 530*b* may be a tubular sleeve threadedly connected between the trigger sub 530*a* and the filtration sub 530*c*. The tandem sub 530*b* includes a rupture piston 536 and rupture disc 538. The rupture piston 536 includes a base 570*a* and a piercing rod 570*b*. The base 570*a* is fixed to an inner surface of the tandem sub 530*b*. The piercing rod 570*b* is extendable from the base 570*a*. The piercing rod 570*b* may be selectively extended by signal from the trigger 110.

The rupture disc 538 may be seated in the tandem sub 530*b* to fluidly isolate the fluid chamber 517*a* from the placement portion 118*b*. The rupture disc 538 may be ruptured by actuation of the piercing rod 570*b*. Upon receipt of the trigger signal, the piercing rod 570*b* may be extended to pass through the rupture disc 538. The piercing rod 570*b* pierces the rupture disc 538 to allow the fluid to pass from the fluid chamber 517*a* therethrough.

The filtration sub 530*c* is threadedly connected between the tandem sub 530*b* and the actuator crossover 230*d*. The filtration sub 530*c* may be similar to the filtration sub 230*c* previously described. In this version, the filtration sub 530*c* has a tapered outer surface that increases in diameter from the tandem sub 530*b* to the actuator crossover 230*d*. The rupture disc 538 is positioned at an uphole end of the filtration sub 530*c* to allow fluid to pass therethrough upon rupturing. The filtration sub 530*c* has the filters 242 therein.

The actuator crossover 230*d* is threadedly connected between the filtration sub 530*c* and the placement portion 118*b*, and operates as previously described to pass fluid from the fluid chamber 517*a* to the placement portion 118*b* for actuating the piston 248 and the door 219 to release the wellbore material 503 from the pressure chamber 217*b* and into the wellbore 105 as previously described. The wellbore material 503 in this version is a sand disposable in the wellbore 105.

Figure 6A:
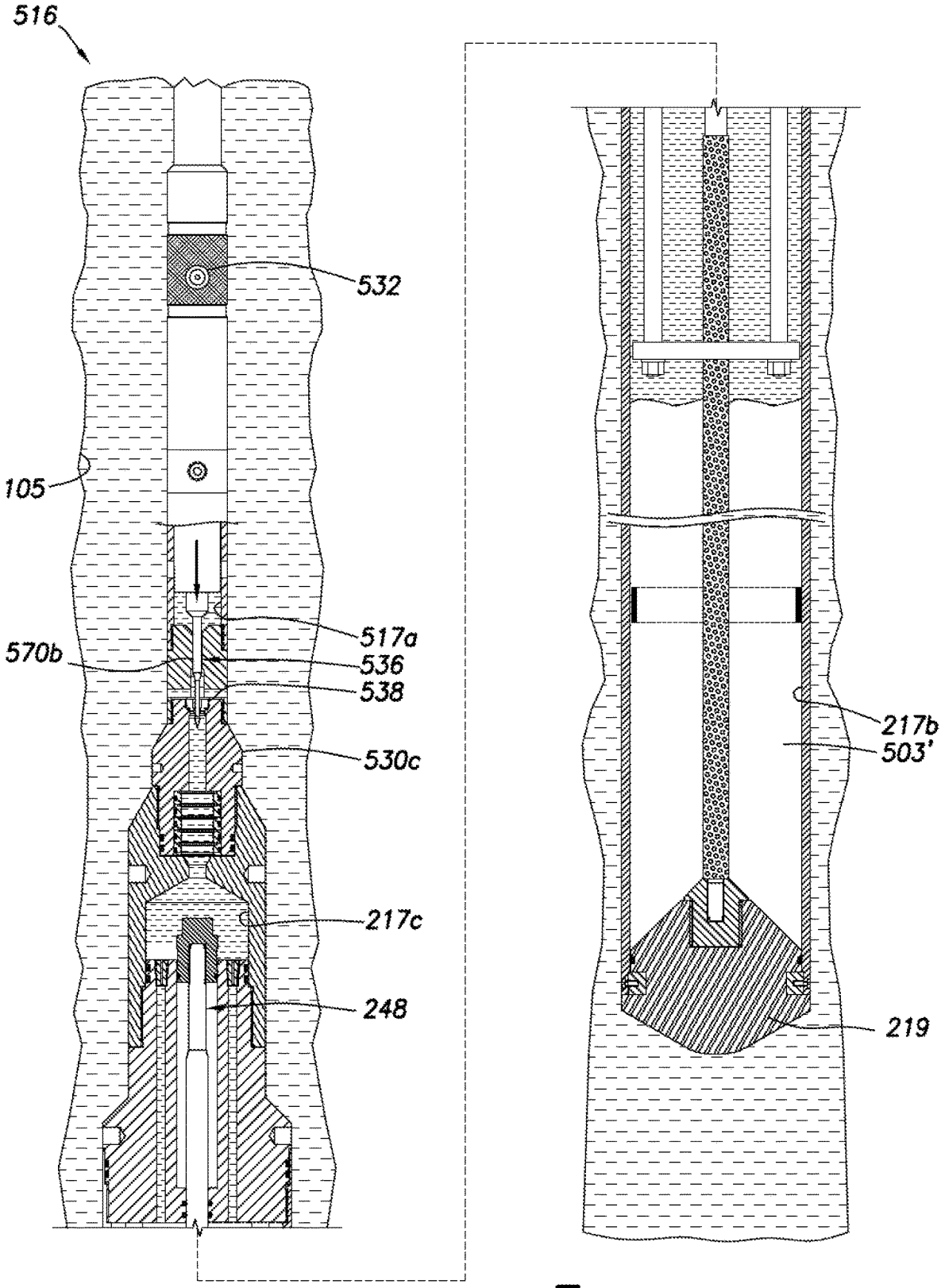
FIGS. 6A-6B are partial cross-sectional views of the downhole placement tool of FIG. 5 in the actuated mode and the placement mode, respectively.
Figure 6B:
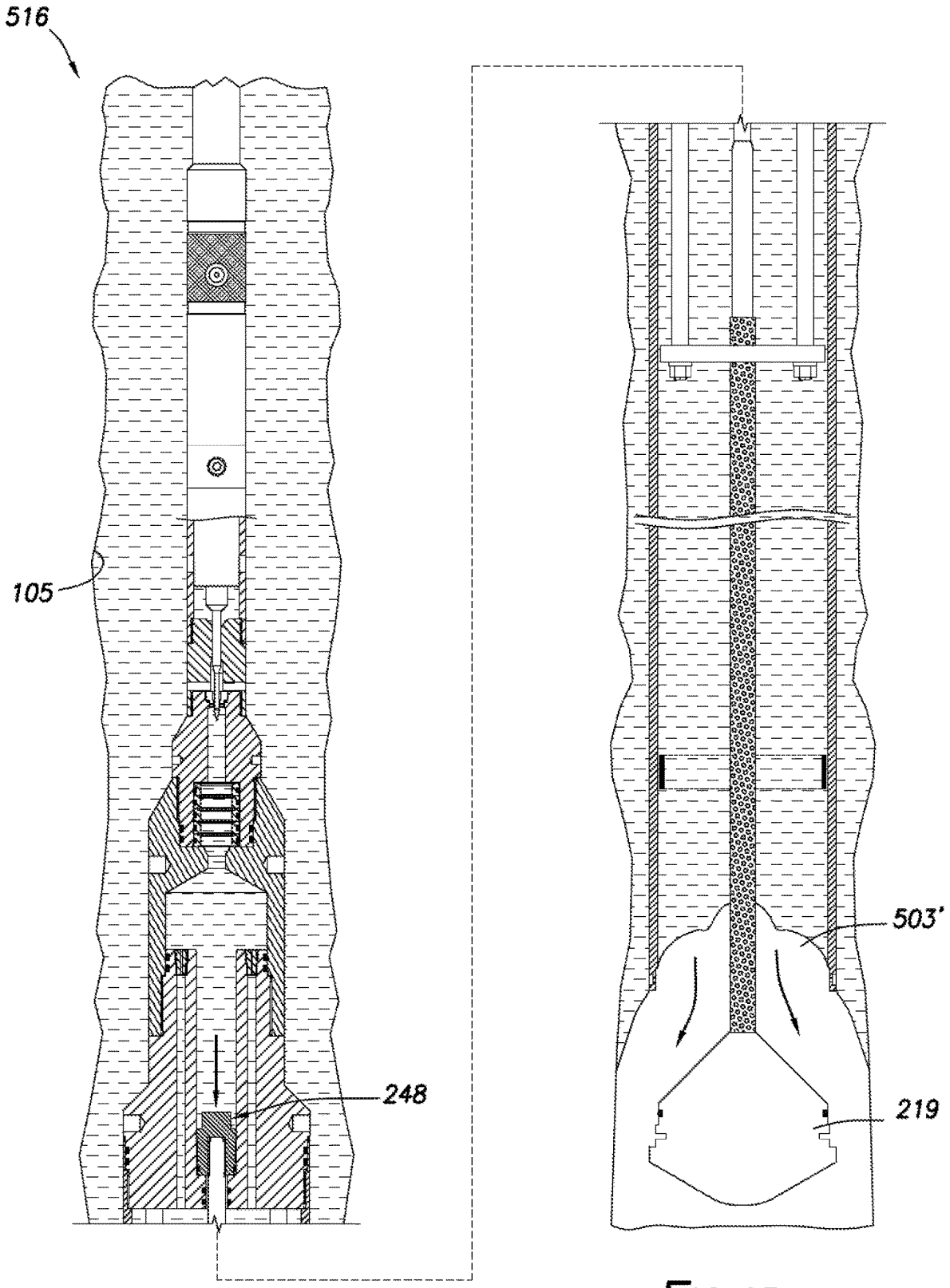

FIGS. 6A and 6B show operation of the electro-hydraulic placement tool 516 in an actuated mode and a placement mode, respectively. FIG. 6A shows the placement tool 516 positioned at a desired depth in the wellbore 105. Fluid from the wellbore 105 passes into the fluid chamber 517*a* via holes in the tandem sub 530*b*. A signal has been sent to trigger the rupture piston 536 to extend the piercing rod 570*b* through the rupture disc 538. The ruptured disc 538 allows the fluid to pass from the fluid chamber 517*a* through into the filtration sub 530*c* and into the actuation chamber 217*c*.

The fluid pressure in actuation chamber 217*c* passes into the pressure chamber 217*b* to invade the wellbore material 503. Upon exposure to the wellbore fluid, the wellbore material 503 quickly forms a fluidized wellbore material 503'. At this point, the forces are insufficient to move the push down piston 248 or open the door 219.

FIG. 6B shows the electro-hydraulic placement tool 516 after the pressure in the placement tool 516 has increased to a level sufficient to drive the push down piston 248 and the door 219 downhole, and to allow the release of the fluidized wellbore material 503' into the wellbore 105. The fluidized wellbore material 503' may be released into the wellbore 105 for performing downhole operations therein.

Figure 7:
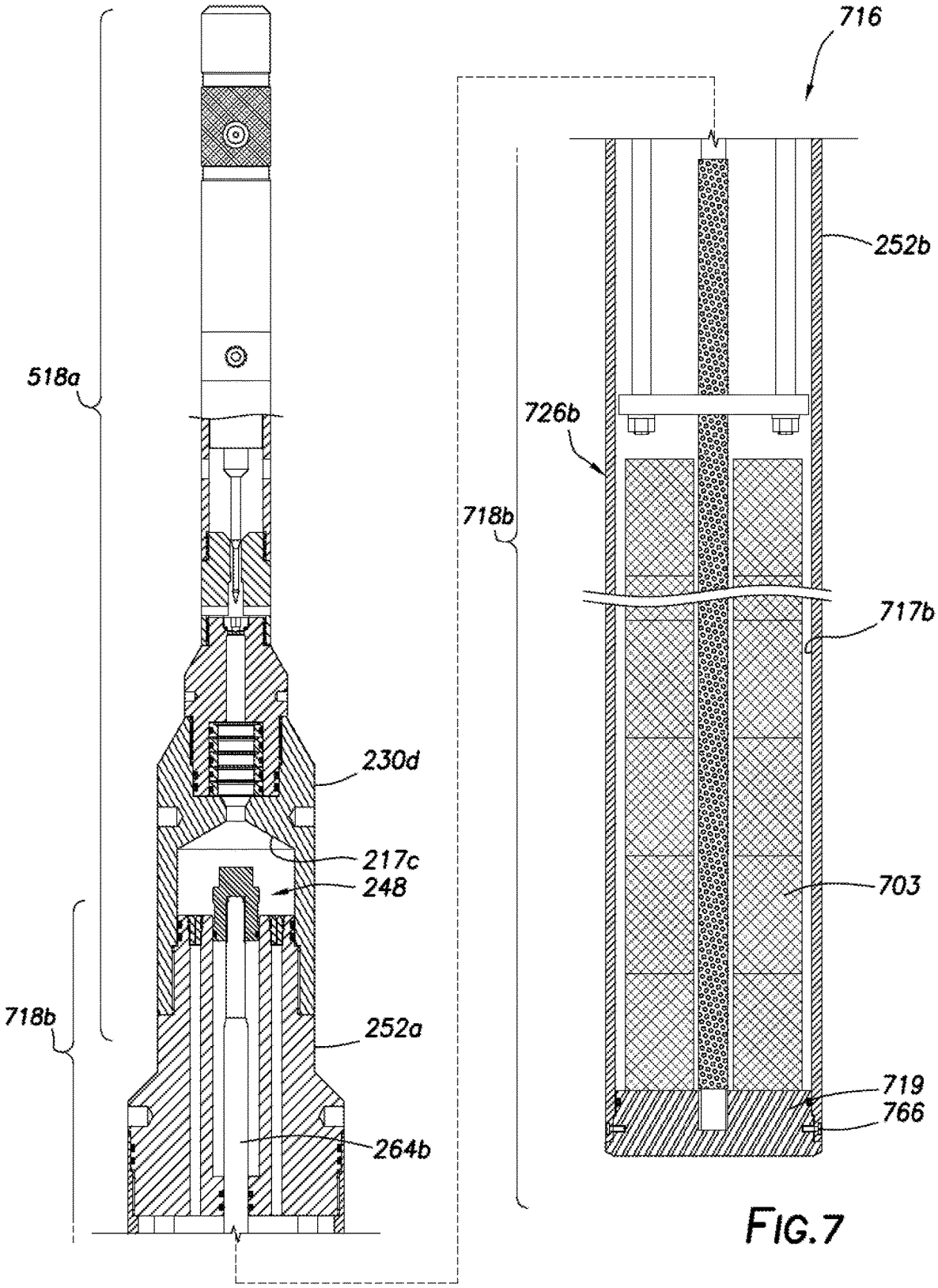
FIG. 7 is a partial cross-sectional view of a piercing downhole placement tool with block wellbore material stored therein.

FIG. 7 show another example downhole placement tool 716 with a modified placement portion 718*b* and a pierce actuator. The placement tool 716 includes the actuation portion 518*a* and a placement portion 718*b*. The actuation portion 518*a* is the same as previously described in FIG. 5. In this version, the placement portion 718*b* is threadedly connected to a downhole end of the actuation portion 518*a* adjacent the actuator crossover 230*d*.

The placement portion 718*b* is similar to the placement portion 118*b*, except that the housing 726*b* and the door 719 have a pressure chamber 717*b* shaped to store a wellbore material in the form of wellbore blocks 703 therein. The housing 726*b* may include the metering sub 252*a* and a placement sleeve 252*b* with the door 719 secured by the shear pins 766. The metering sub 252*a* operates as previously described to pass fluid from the actuation chamber 217*c* and into the pressure chamber 717*b* to invade the wellbore blocks 703. The pressure chamber 717*b* is depicted as a cylindrical chamber, and the door 719 is depicted as having a cylindrical shape with a flat surface to support the wellbore blocks 703.

The wellbore blocks 703 may be a set of cuboid shaped blocks stacked within the pressure chamber 717*b*. The blocks may optionally be in the form of donut shaped discs stackable within the pressure chamber 717*b* with the push rod 264*b* of the push down piston 248 extending therethrough. As demonstrated by FIG. 7, the wellbore material 703 may have a variety of shapes, and the placement portion 718*b* may be conformed to facilitate storage and placement thereof.

Figure 8A:
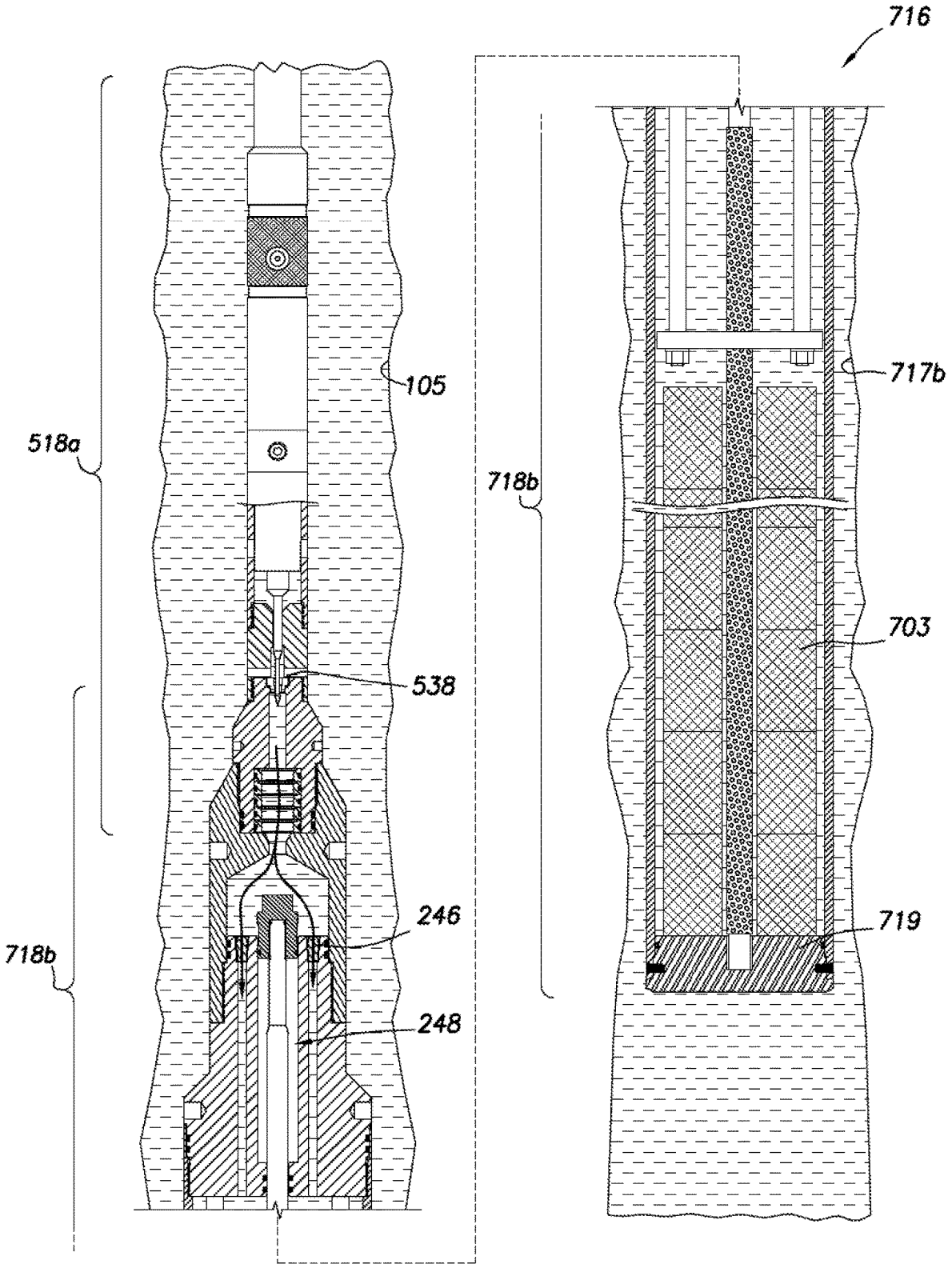
FIGS. 8A-8B are partial cross-sectional views of the downhole placement tool of FIG. 7 in the actuated mode and the placement mode, respectively.
Figure 8B:
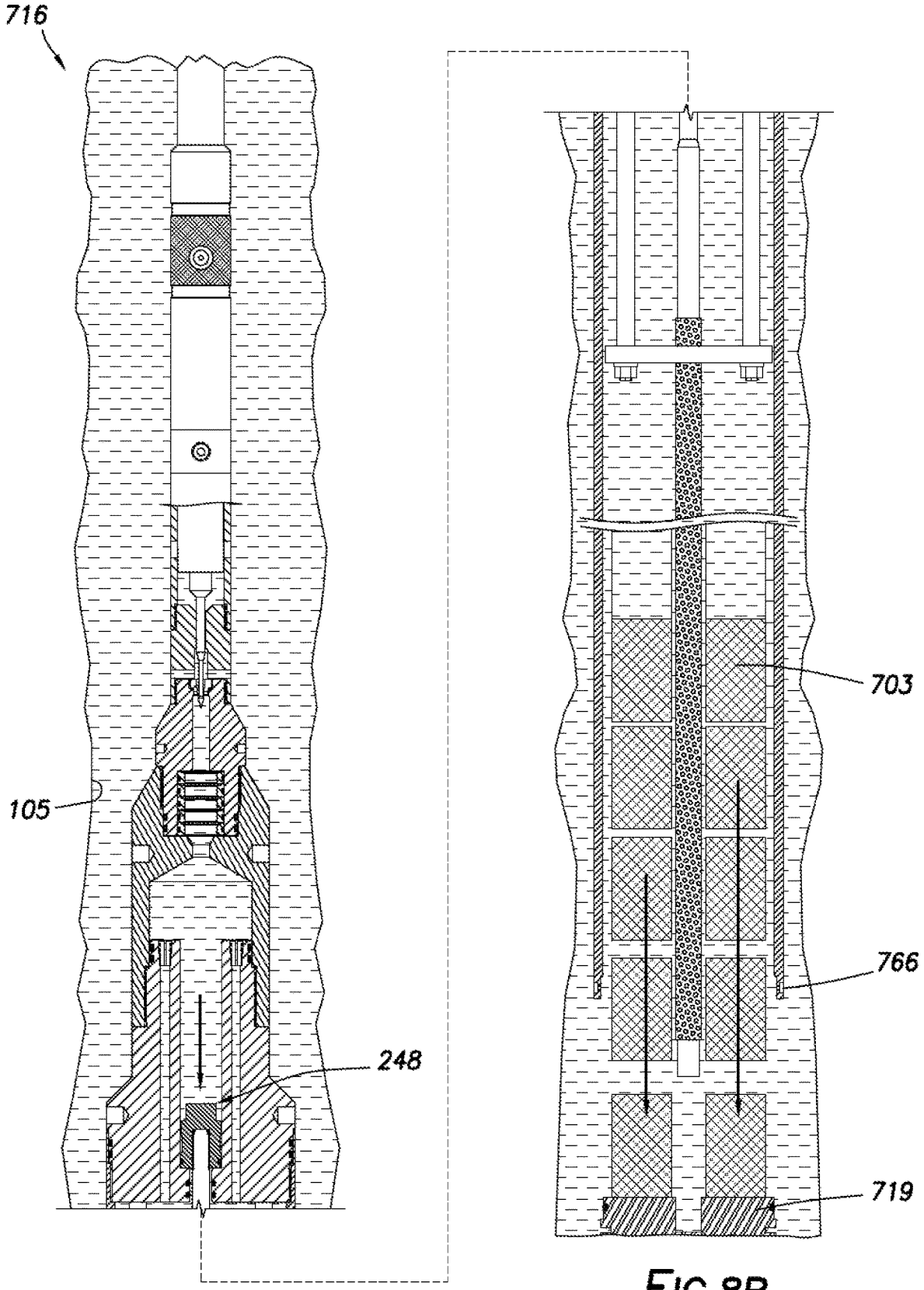

FIGS. 8A and 8B show operation of the block release placement tool 716 in an actuated mode and a placement mode, respectively. FIG. 8A shows the placement tool 716 positioned at a desired depth in the wellbore 105. In this view, the wellbore fluid has passed into the actuation portion 518*a*, through the pierced rupture disc 538 and to the placement portion 718*b* as previously described. The fluid in the placement portion 718*b* passes through the metering jets 246 and into the pressure chamber 717*b* to invade the wellbore blocks 703. In this view, the forces in the placement portion 718*b* are insufficient to drive the push down piston 248 and the door 719 downward.

FIG. 8B shows the block release placement tool 716 after the pressure in the placement tool 716 has increased to a level sufficient to drive the push down piston 248 and the door 719 downhole, and to allow the release of the wellbore blocks 703 into the wellbore 105. The wellbore blocks 703 are deployed into the wellbore 105 upon breakage of the shear pins 766 and the release of the door 719.

FIGS. 9A-9G show various configurations of the wellbore material including pellet, block, cylindrical, and fluted configurations. One or more of these and/or other wellbore materials as shown may be used in one or more of the various placement tools described herein. Various combinations of the features (e.g., size, geometry, quantity, shape, etc.) of one or more of the wellbore materials may be used.

Figure 9A:
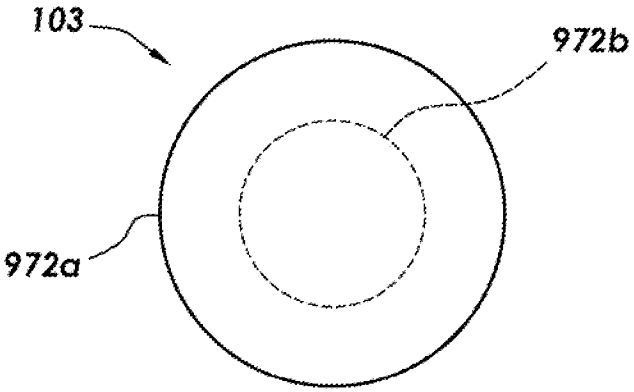
FIGS. 9A-9G show various configurations of the wellbore material.

FIG. 9A shows a pellet shaped wellbore material 103. The pellet shaped material is shown as a spherical component, such as a ball. Examples of the pellet wellbore material 103 are shown in use in the placement tool 216 of FIGS. 2A, 4A-4C, 10A-11C, and 13A-14B.

Figure 9B:
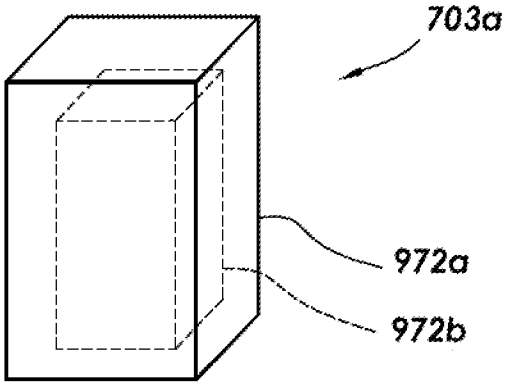
Figure 9C:
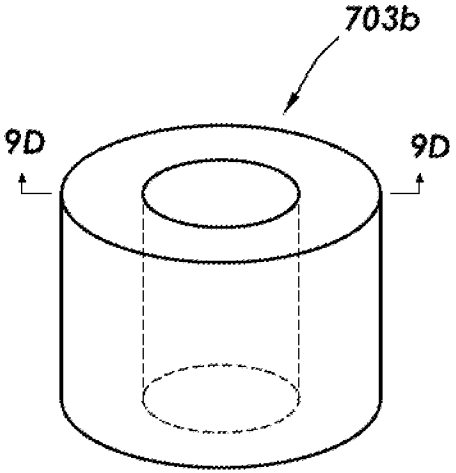
Figure 9D:
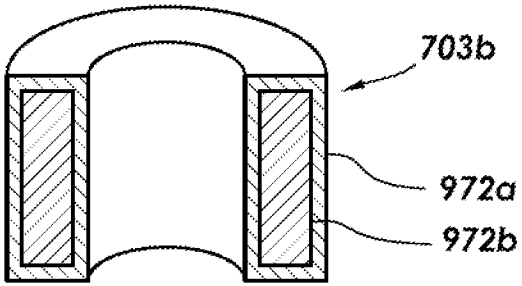

FIG. 9B shows a block shaped wellbore material 703*a*. The block wellbore material 703*a* is shown in use in the placement tool 716 of FIGS. 7 and 8A-8B. FIGS. 9C and 9D show a perspective and a cross-sectional view (taken along line 9D-9D) of another version of the block shaped material 703*b* usable in the placement tool 716 of FIG. 7. In this version, the block has a cylindrical shape positionable in the tool 716 with the rod extending through a central passage therein. The cylindrical wellbore material 703*b* may be cut into portions as indicated by the cross-sectional view of FIG. 9D.

Figure 9F:
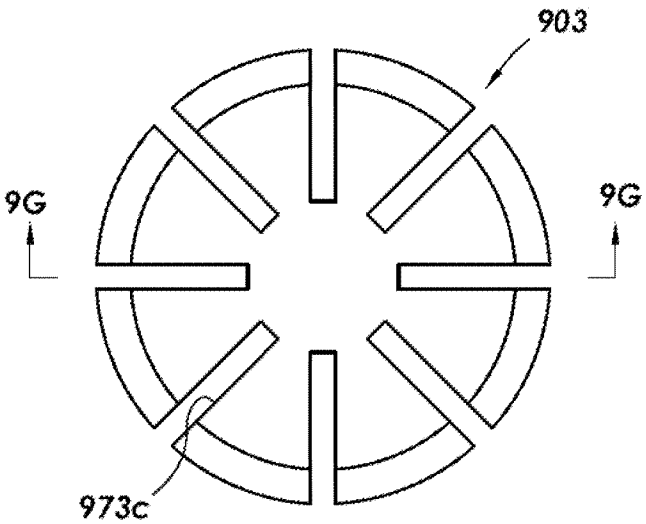
Figure 9G:
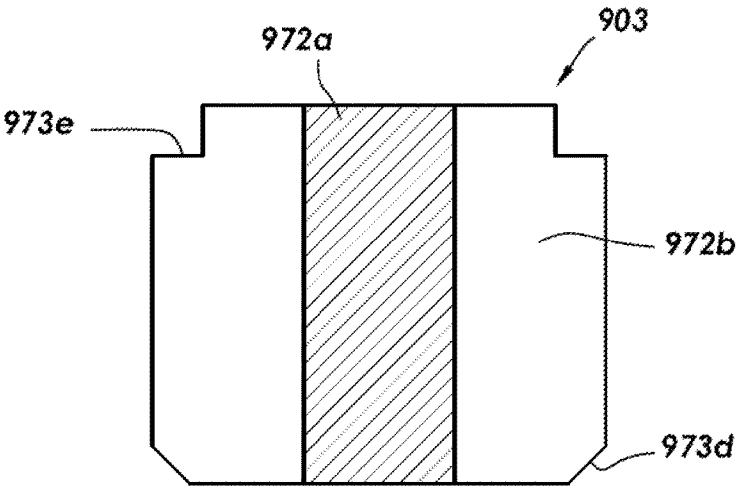
Figure 9E:
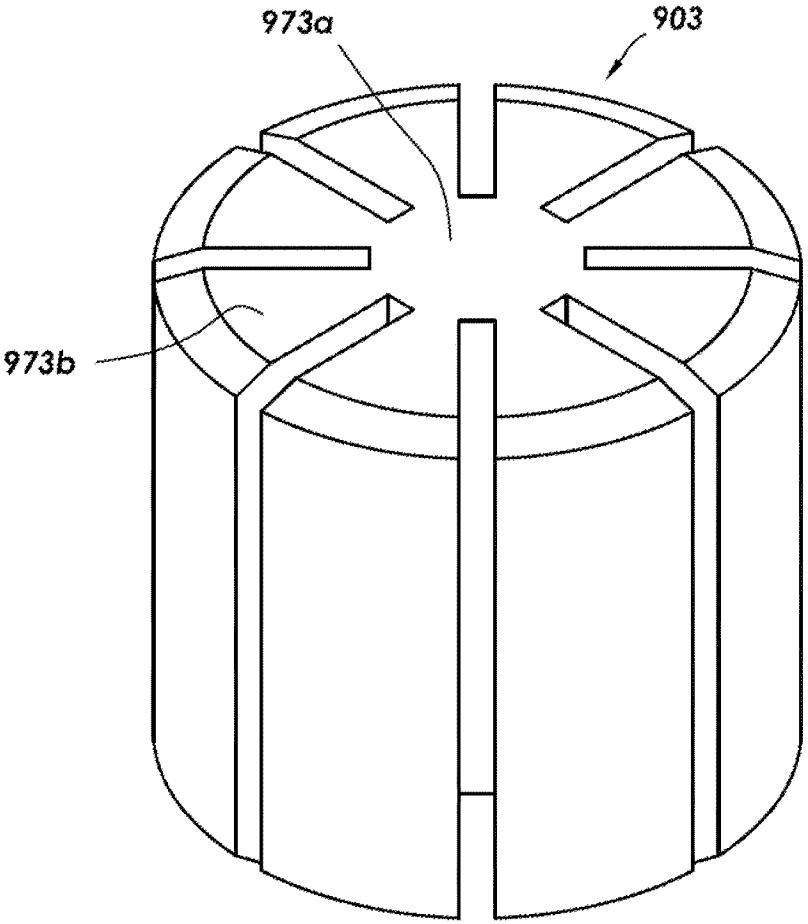

FIGS. 9E-9G show perspective, top, and longitudinal cross-sectional views, respectively, of a fluted shaped wellbore material 903. This version is a cylindrical member with a central hub 973*a* and radial wings 973*b* extending therefrom. This version is similar to the cylindrical version of FIG. 9C, except that the central passage has been removed and the radial cuts 973*c* have been added.

Each of the wellbore materials includes an outer coating 972*a* and a core 972*b*. The coating 972*a* may be a fluid soluble material, such as sugar, that surrounds and protects the core 972*b* during transport. The coating 972*a* may encase the core 972*b* until sufficient exposure of fluid (e.g., water, drilling mud, etc.) disintegrates the coating 972*a* as is described further herein (see, e.g., FIGS. 10A-11C). The core 972*b* may be a solid and/or liquid usable in the wellbore, such as a sealant (e.g., bentonite), polymer, mud, acid, pellets, sand, blocks, epoxy, and/or other material. The core 972*b* may be a material that reacts with the fluid to form a sealing material capable of sealing a portion of the wellbore.

As shown in the fluted configuration of FIGS. 9E-9G, the fluted shaped wellbore material 903 is provided with radial wings 973*b* defined by extending radial cuts towards the central hub. The radial cuts may provide additional surface area for the coating 972*a* to cover portions of the core 972*b*. In some cases, it may be helpful to reduce a thickness of the core 972*b* to allow sufficient fluid to seep into and mix with all portions of the wellbore material 903, thereby activating its sealing capabilities. The fluted wellbore material 903 may also be provided with bevels 973*d*, shoulders 973*e*, and/or other features. The radial cuts in the fluted wellbore material 903 may be used to increase the surface area by an amount of, for example, about 145%.

The fluted wellbore material 903 may be shaped to facilitate placement into and/or use with the placement tool (e.g., 1216 of FIG. 12A) as is described further herein. By way of example, dimensions of the fluted wellbore material 903 include an outer diameter of about 4.50 inches (11.43 cm), a height of about 3.75 inches (9.52 cm), a shoulder of about 0.5 inches (12.70 mm) at one end, a chamber of about 0.38 inches (9.65 mm)×about 45 degrees at an opposite end, and eight radial flutes each of about 1.50 inches (3.81 cm)×0.25 inches (6.35 mm) and about 45 degrees F. (7.22 C).

Figure 10A:
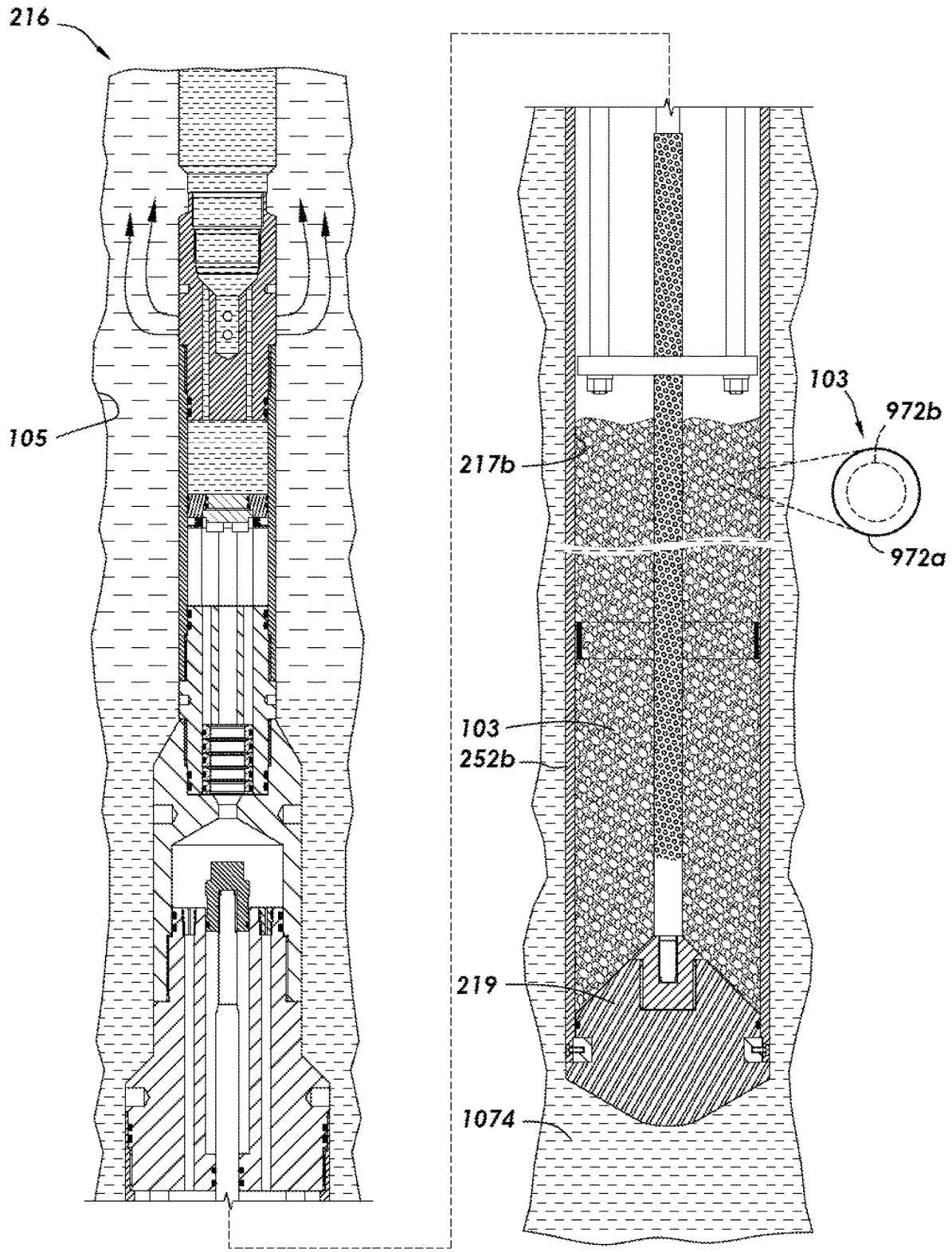
FIGS. 10A-10C show additional views of the downhole placement tool of FIG. 2A in a run-in mode, actuated mode, and a placement mode, respectively, during a drop placement operation.
Figure 10B:
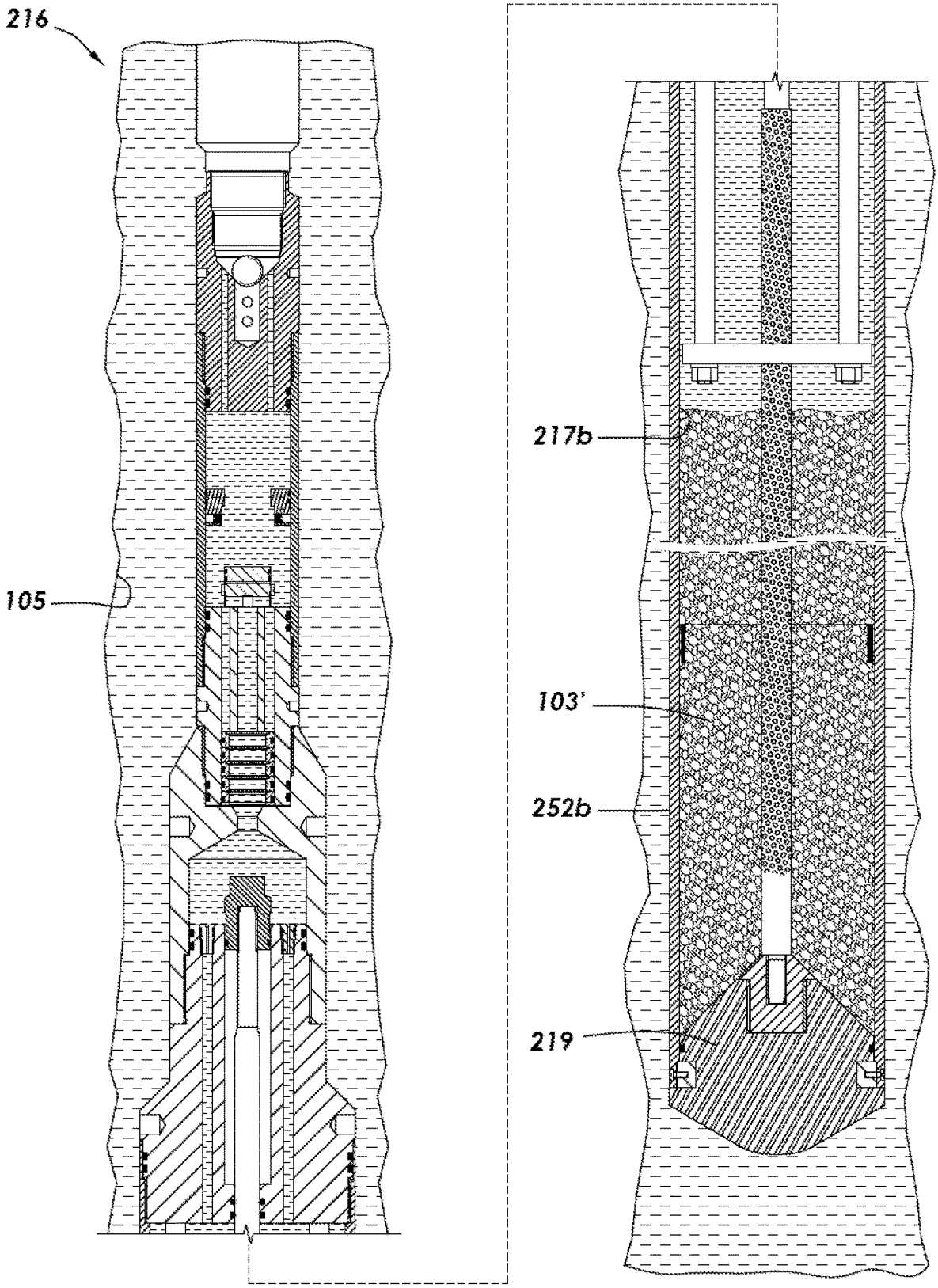
Figure 10C:
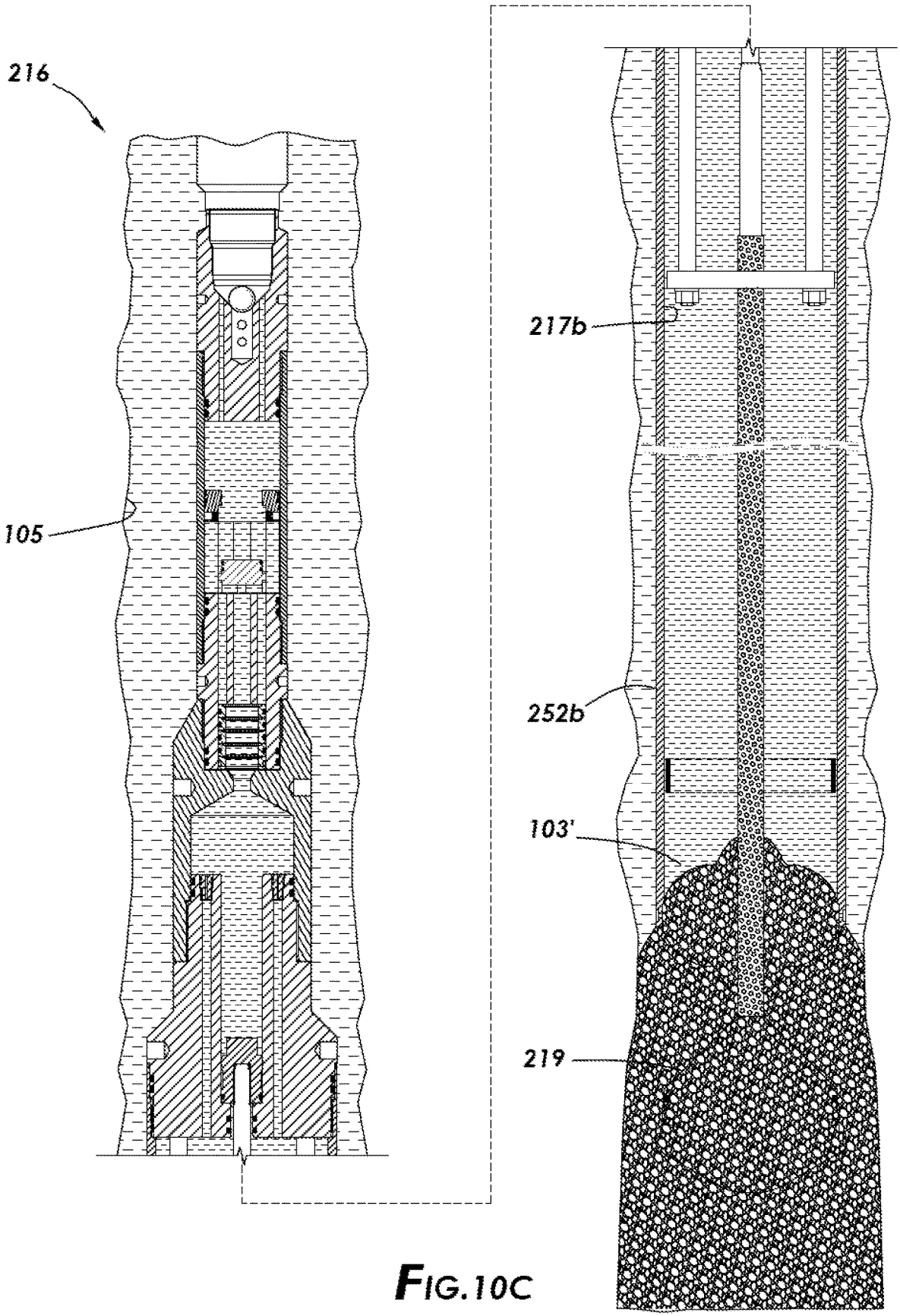

FIGS. 10A-11C depict the downhole placement tool of FIG. 2A during a drop placement operation. In FIGS. 10A-10C, the downhole placement tool 216 is depicted in a run-in mode, actuated mode, and a placement mode, respectively. As described previously, the wellbore material 103 is isolated in the placement sleeve 252*b* (FIG. 10A) until the placement tool 216 is activated by pressure (FIG. 10B) to open the door 219 (FIG. 10C).

As shown in the detail of FIG. 10A, placement tool 216 is carrying the pellet wellbore material 103 in its original state with the coating 972*a* disposed about the core 972*b*. The wellbore material 103 is maintained in a dry state (FIG. 10A) until the wellbore fluid 1074 is passed into the pressure chamber 217*b* to form the fluidized wellbore material (or wellbore mixture) 103' (FIG. 10B), and the fluidized wellbore material 103' is released into the wellbore 105. The wellbore material 103 may be placed under pressure in the placement tool 216 to prevent a surge of fluid (e.g., water) from entering and pushing into the system. Temperature inside may not increase like it would with air, so heat transfer may be limited to radiation and conduction through the pellet wellbore material 103. During this time, the wellbore material 103 may be conveyed in a vacuum to allow a reaction with fluid to be more inert. The fluidized wellbore material 103' may then be exposed to the wellbore fluid 1074. Once exposed to the wellbore fluid 1074, the core 972*b* of the fluidized wellbore material 103' may start to disintegrate, but the core 972*b* is not yet exposed to the wellbore fluid 1074.

Figure 11A:
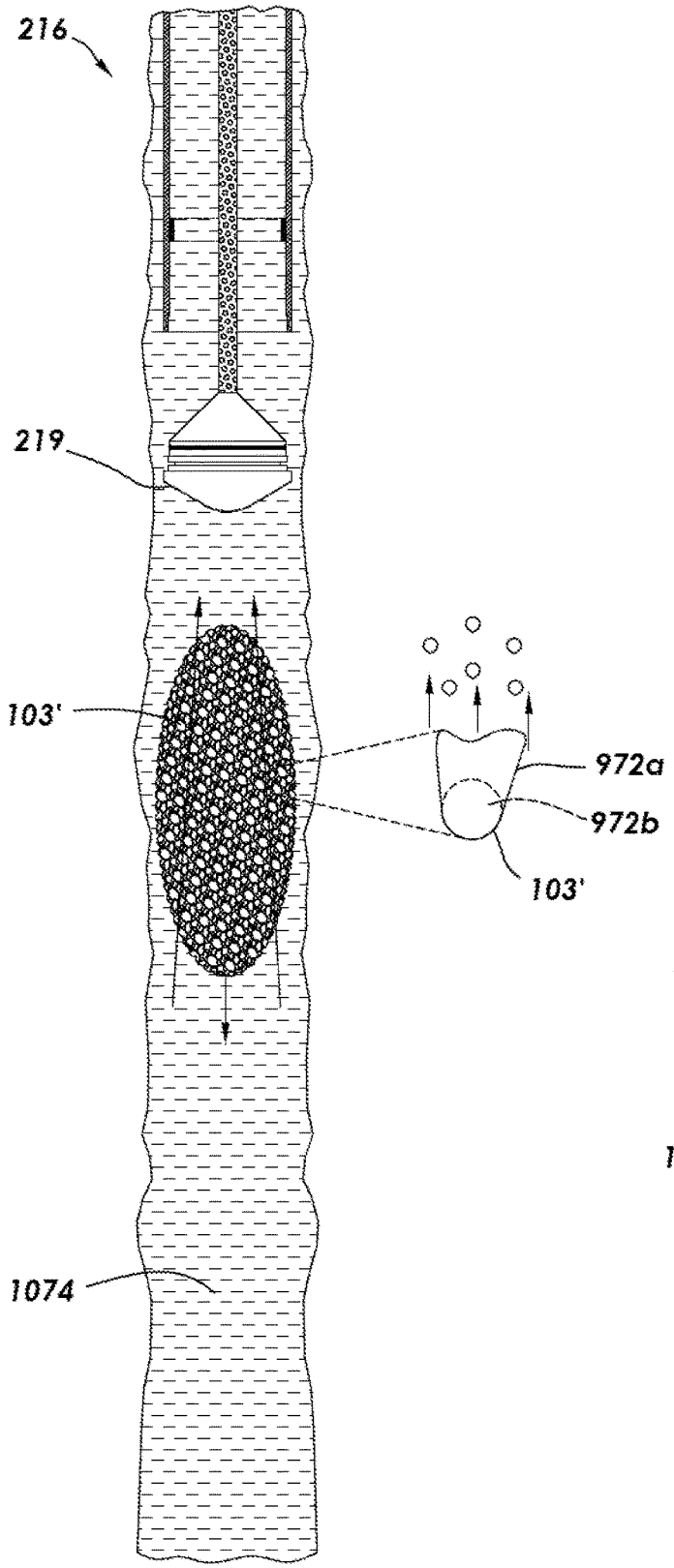
FIG. 11A-11C show activation of the pellet wellbore material of the downhole placement tool of FIG. 10C as the wellbore material falls a distance through the wellbore, is washed by wellbore fluid, and is placed in the wellbore, respectively.
Figure 11B:
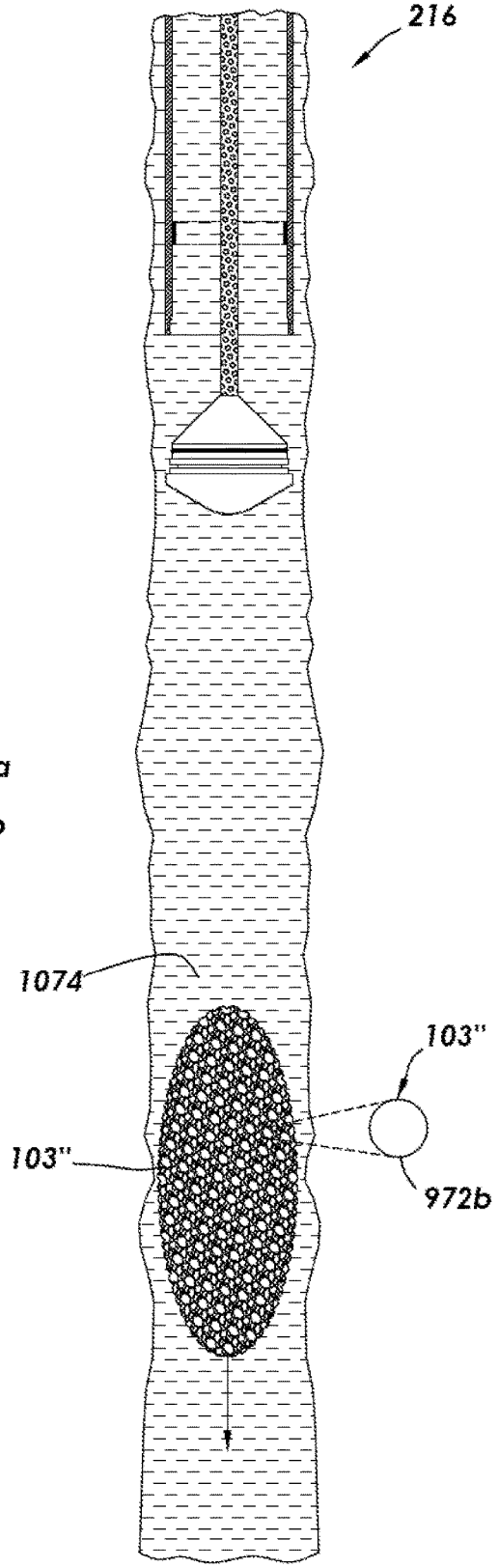
Figure 11C:
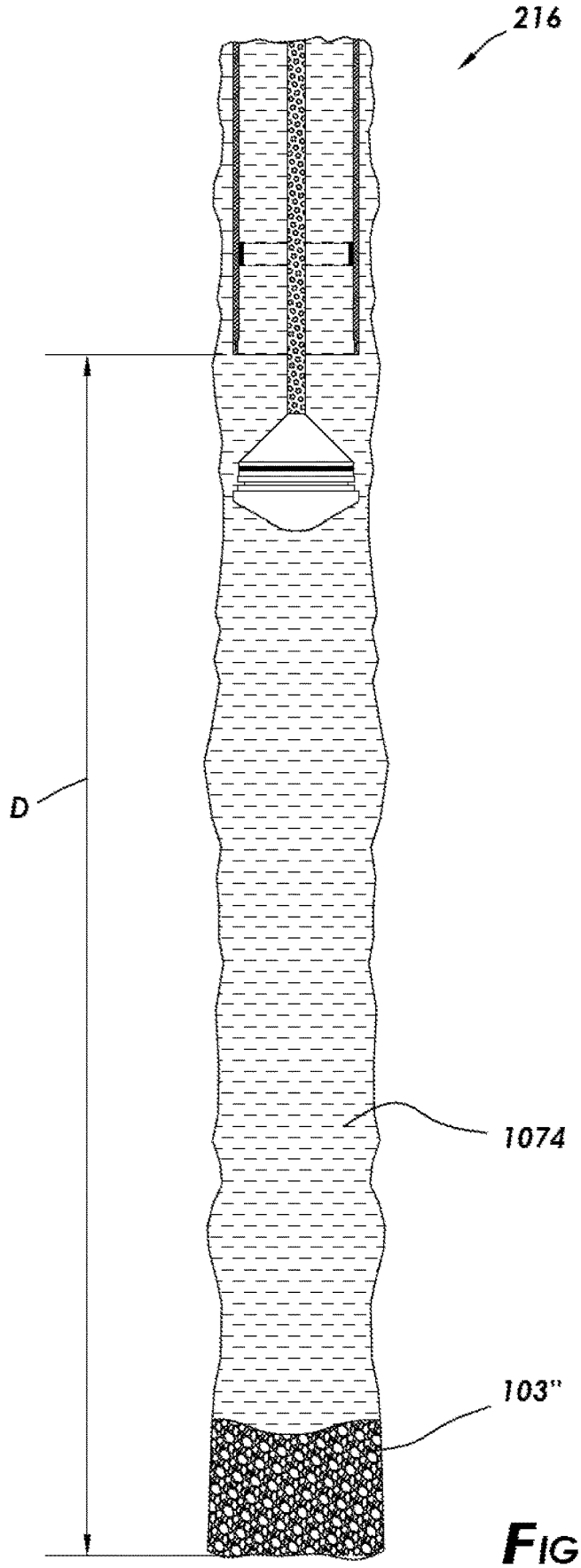

FIGS. 11A-11C show activation of the wellbore material 103 during the wellbore drop operation. As shown in these views, the door 219 is opened and the fluidized wellbore material 103' is released from the downhole placement tool 216. The fluidized wellbore material 103' falls through the wellbore 105. As the fluidized wellbore material 103' falls through the wellbore 105, the wellbore fluid 1074 passes over the fluidized wellbore material 103' as indicated by the arrows. As the wellbore fluid 1074 passes over the fluidized wellbore material 103', the coating 972*a* washes away as shown in the detail of FIG. 11A. Because the fluidized wellbore material 103' is moving through the wellbore 105, the fluidized wellbore material 103' engages fresh wellbore fluid 1074 along the way with fresh capabilities of washing away the coating 972*a* as indicated by the arrows and droplets. This falling action thereby provides both an abrasive action of the wellbore fluid 1074 passing over the fluidized wellbore material 103' and a washing action caused by engagement with the fresh wellbore fluid 1074 as the fluidized wellbore material 103' reaches new depths.

The fluidized wellbore material 103' may fall a sufficient distance to allow the wellbore fluid 1074 to engage the fluidized wellbore material 103' and remove the coating 972*a*. The distance may be, for example, from about 100-200 feet (30.48-60.96 m). By removing the coating 972*a*, the core 972*b* of the fluidized wellbore material 103' is exposed to the wellbore fluid 1074 and reacts therewith to form an activated wellbore material 103". Once the core 972*b* of the fluidized wellbore material 103' reacts with the wellbore fluid 1074, the fluidized wellbore material 103' is converted to activated wellbore material 103". The activated wellbore material 103" has adhesive capabilities for securing the activated wellbore material 103" in place in the wellbore 105. The activated wellbore material 103" may then seat in the wellbore 105 as shown in FIG. 11C.

In an example, a wellbore material 103 made of sodium (NA) bentonite pellets having a bentonite core and a fluid (e.g., water) soluble coating is provided. The downhole placement tool 216 is loaded with 150 lb-mass (68.04 kg) of the wellbore material. The downhole placement tool 216 is lowered to a depth of 9,800 ft (2.99 km) and 250 degrees F. (121.11 C) downhole. The placement tool 216 stops descending and then reverses motion so that it ascends at a rate of 10 m/min. During the ascension, the placement tool 216 is actuated to fluidize the wellbore material 103, and to release the fluidized wellbore material 103' as the downhole tool rises. The fluidized wellbore material 103' falls a distance D of 200 ft (60.96 m) through the wellbore to a position for sealing. During the drop, the wellbore fluid 1074 washes over the fluidized wellbore material 103', removes its coating 972*a*, and exposes its core 972*b*. The core 972*b* of the fluidized wellbore material 103' is exposed to the wellbore fluid 1074 and reacts therewith. The activated wellbore material 103" is secured in the wellbore 105 to form a seal in the wellbore 105.

Once released, the fluidized wellbore mixture 103' may move out of the placement tool 216 and flow laterally outward and upward around a gap between the placement tool 216 and a wall of the wellbore 105 at an upward casing/tool annular fluid velocity. When run into the hole on coiled tubing, fluid may be pumped into the wellbore at a constant rate (pump-down fluid rate) of about 0.25 barrels per minute (29.34 L/min). The placement tool 216 may be activated by dropping the ball 109 into the tool after some pumping (e.g., about 15-20 minutes).

During the wellbore drop operation, the placement tool 216 may then be retracted a distance uphole (tool pull out of hole (POOH)) by pulling the conveyance (e.g., coiled tubing) and then pumping again. The conveyance may be retracted at a velocity of, for example, about 25 ft/min (12.7 m/min) when fluid is flowing at a flow rate of about 10 ft/min (5.08 m/min). This may be used to prevent the placement tool 216 from sticking in the wellbore 105. After pumping again, the placement tool 216 floods the chamber 217*b* with fluid until its internal pressure builds to equal wellbore pressure outside the placement tool 216. Once the internal pressure increases over the wellbore pressure by about 200-400 psid+ (1378.95-2757.90 kPa), the shear pins 266 are sheared and the door 219 opens to release the fluidized wellbore material 103'. The fluidized wellbore material 103' may then fall downhole rather than passing around the placement tool 216 and flowing uphole.

Table 1 below shows example placement parameters that may be used for placement of NA-Bentonite pellets when using the placement tool.

TABLE 1

NA-BENTONITE PELLETS PLACEMENT: POOH
Rates for use after Actuation

| | | | |
|---|---|---|---|
| Casing ID (in)/(cm) = | 6.45/16.38 | Tool OD (in)/(cm) = | 5.50/13.97 |
| Casing Diametral Annular Gap (in)/(cm) = | 0.95/2.41 | Casing/Tool Diametral Annular Flow Area ($in^2$)/($cm^2$) = | 8.91/22.63 |
| Pump-down Fluid Rate (barrels/min)/(L/min) | Pump-down Fluid Rate (gallons/min)/(L/min) | Upward Casing/Tool Annular Fluid Velocity (ft/min)(m/min) | Recommended. Tool POOH rate (ft/min)/(m/min) |
| 0.10/11.73 | 4.20/15.90 | 9.1/2.77 | 23/7.01 |
| 0.15/17.60 | 6.30/23.85 | 13.6/4.15 | 34/10.36 |
| 0.20/23.47 | 8.40/31.80 | 18.1/5.52 | 45/13.72 |
| 0.25/29.34 | 10.50/39.75 | 22.7/6.92 | 57/17.37 |
| 0.30/35.20 | 12.60/47.70 | 27.2/8.29 | 68/20.73 |
| 0.35/41.07 | 14.70/55.65 | 31.8/9.69 | 79/24.08 |
| 0.40/46.94 | 16.80/63.60 | 36.3/11.06 | 91/27.74 |
| 0.45/52.81 | 18.90/71.54 | 40.8/12.44 | 102/31.09 |
| 0.50/58.67 | 21.00/79.49 | 45.4/13.84 | 113/34.44 |
| 0.55/64.54 | 23.10/87.44 | 49.9/15.21 | 125/38.1 |

where Casing ID is the inner diameter of the casing in the wellbore, the Tool OD is an outer diameter of the placement tool, and POOH is the pull out of hole rate.

Figure 12A:
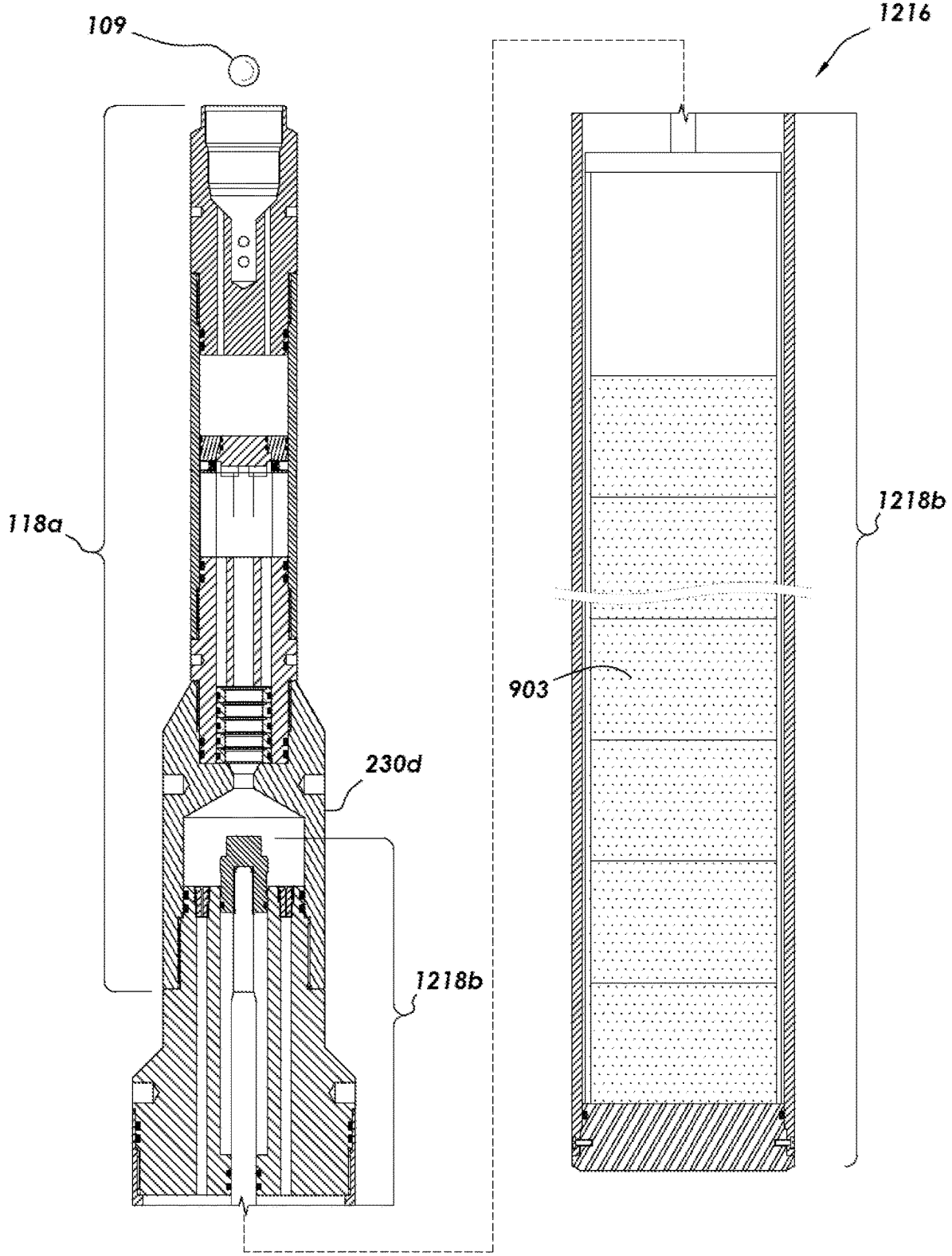
FIGS. 12A and 12B are cross-sectional and exploded views, respectively, of the placement tool of FIG. 2A with a placement sleeve, and with a fluted wellbore material stored therein.
Figure 12B:
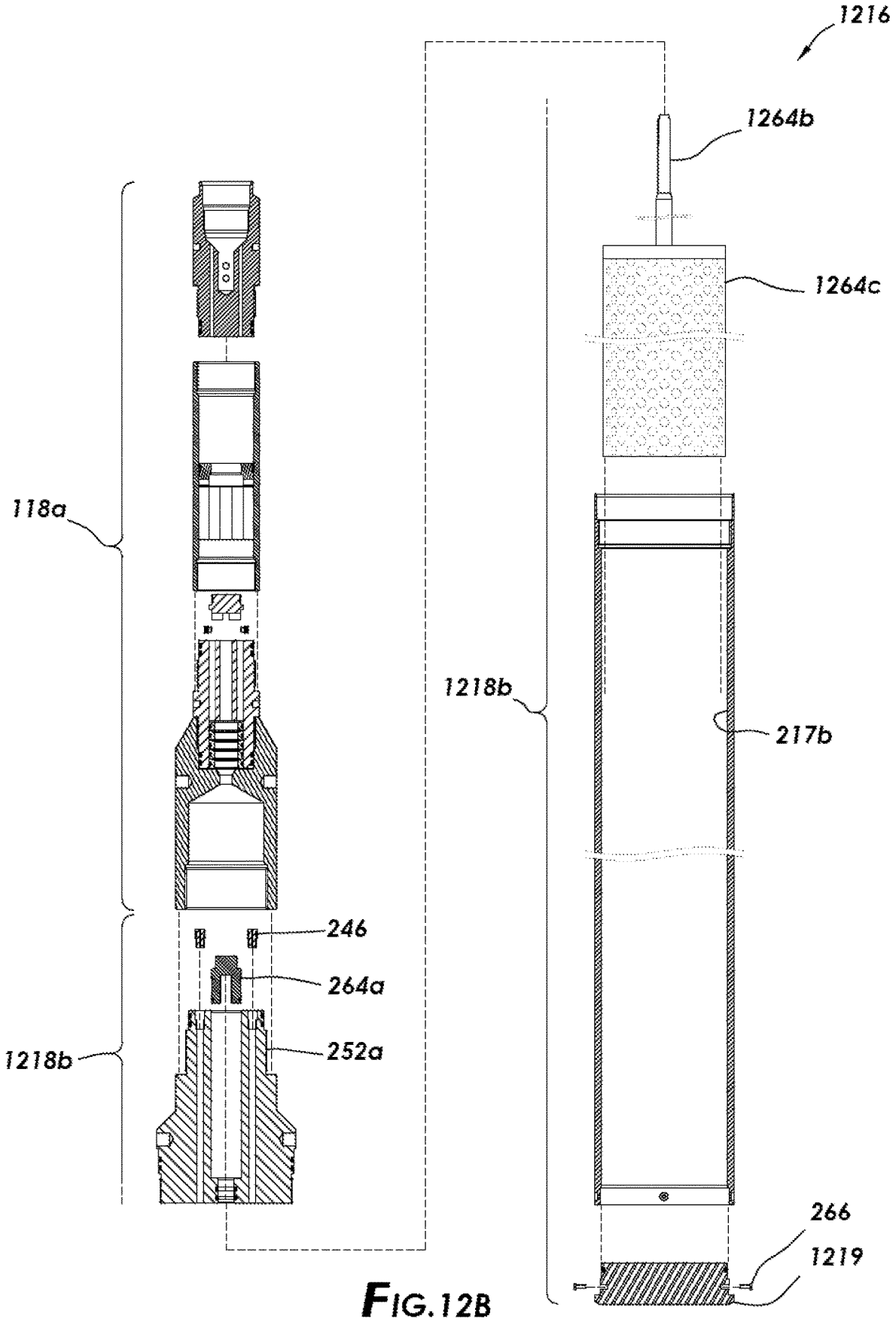

FIGS. 12A and 12B are cross-sectional and exploded views, respectively, of an example peripheral downhole placement tool 1216. The peripheral placement tool 1216 includes the actuation portion 118*a* of FIG. 2A and a modified placement portion 1218*b*. In this version, the placement portion 1218*b* is threadedly connected to a downhole end of the actuation portion 118*a* adjacent the actuator crossover 230*d*.

The placement portion 1218*b* is similar to the placement portion 118*b* including the same metering jets 246, metering sub 252*a*, placement sleeve 252*b* (with pressure chamber 217*b* therein), piston head 264*a*, and shear pins 266. In this version, the passage plate 258 and long bolts 260 of FIG. 2A have been removed and the push rod 264*b*, tube sleeve 264*c*, and door 219 have been replaced with a screen rod 1264*b*, peripheral screen 1264*c*, and door 1219. The screen rod 1264*b* has an end receivable by the metering sub 252*a* and an opposite end connected to an uphole end of the peripheral screen 1264*c*.

The uphole end of the peripheral screen 1264*c* has a plate connected to the screen rod 1264*b* for movement therewith. As pressure is applied to the screen rod 1264*b*, the screen rod 1264*b* is advanced downhole, thereby driving the plate and attached peripheral screen 1264*c* downhole. This action increases pressure in the placement sleeve 252*b* which ultimately ruptures the shear pins 266 opens the door 1219 to release the wellbore material 903.

The wellbore material 903 is shown as the fluted blocks 903 stacked within the placement sleeve 252*b*. The peripheral (perforated) screen 1264*c* lines the placement sleeve 252*b* and provides a minimal annulus for fluid flow therebetween. This annulus permits fluid flow along a periphery of the fluted wellbore material 903 to engage the fluted material 903 and penetrate into its radial cuts 973*c* (FIG. 9E). The radial cuts 973*c* in the fluted blocks 903 allow fluid to pass axially through the pressure chamber 217*b*. The peripheral screen 1264*c* is positioned radially about the fluted blocks 903 to facilitate flow of fluid therethrough.

Figure 13A:
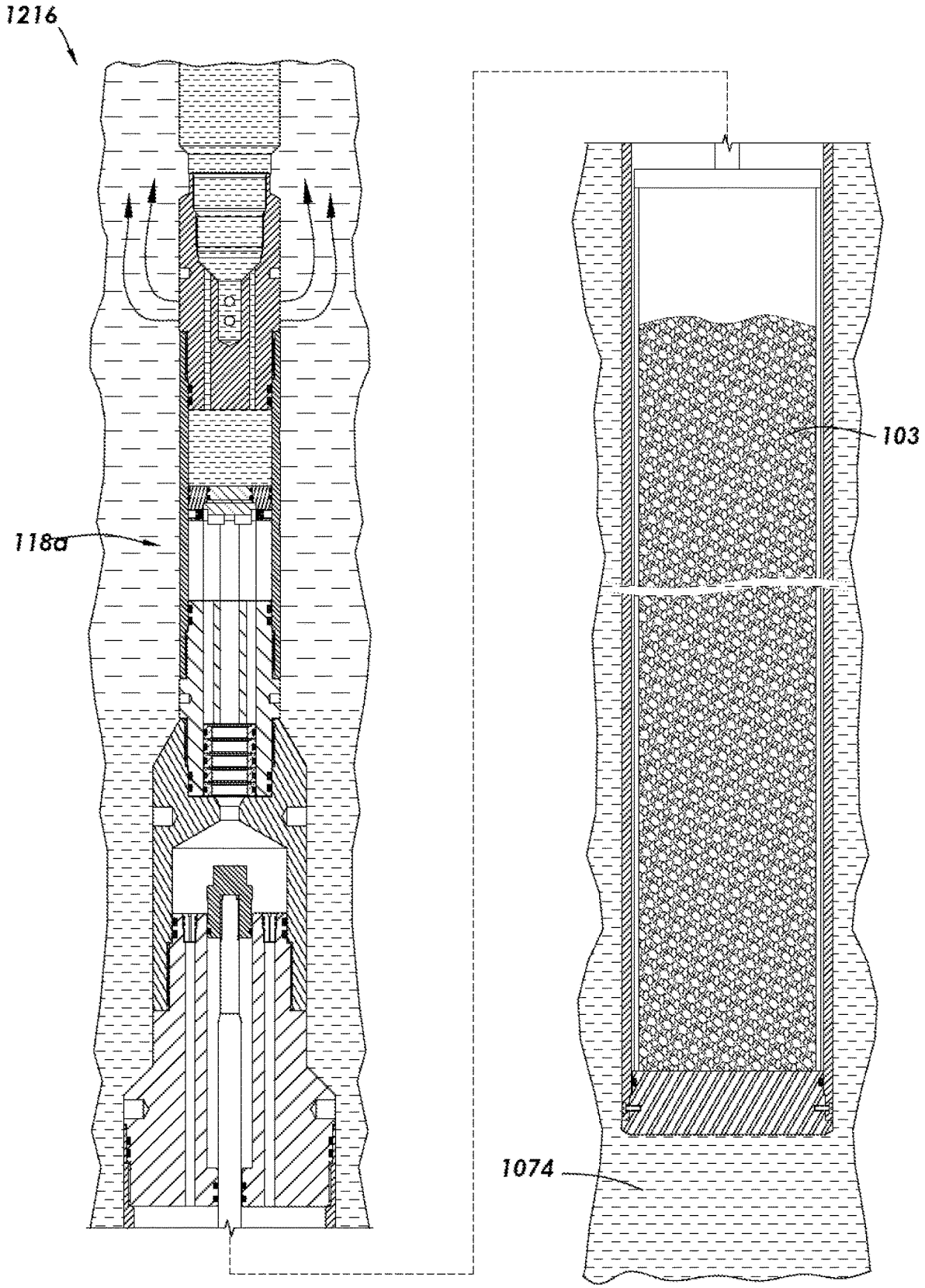
FIGS. 13A-13C show the downhole placement tool of FIG. 12A in a run-in mode, actuated mode, and a placement mode, respectively.
Figure 13B:
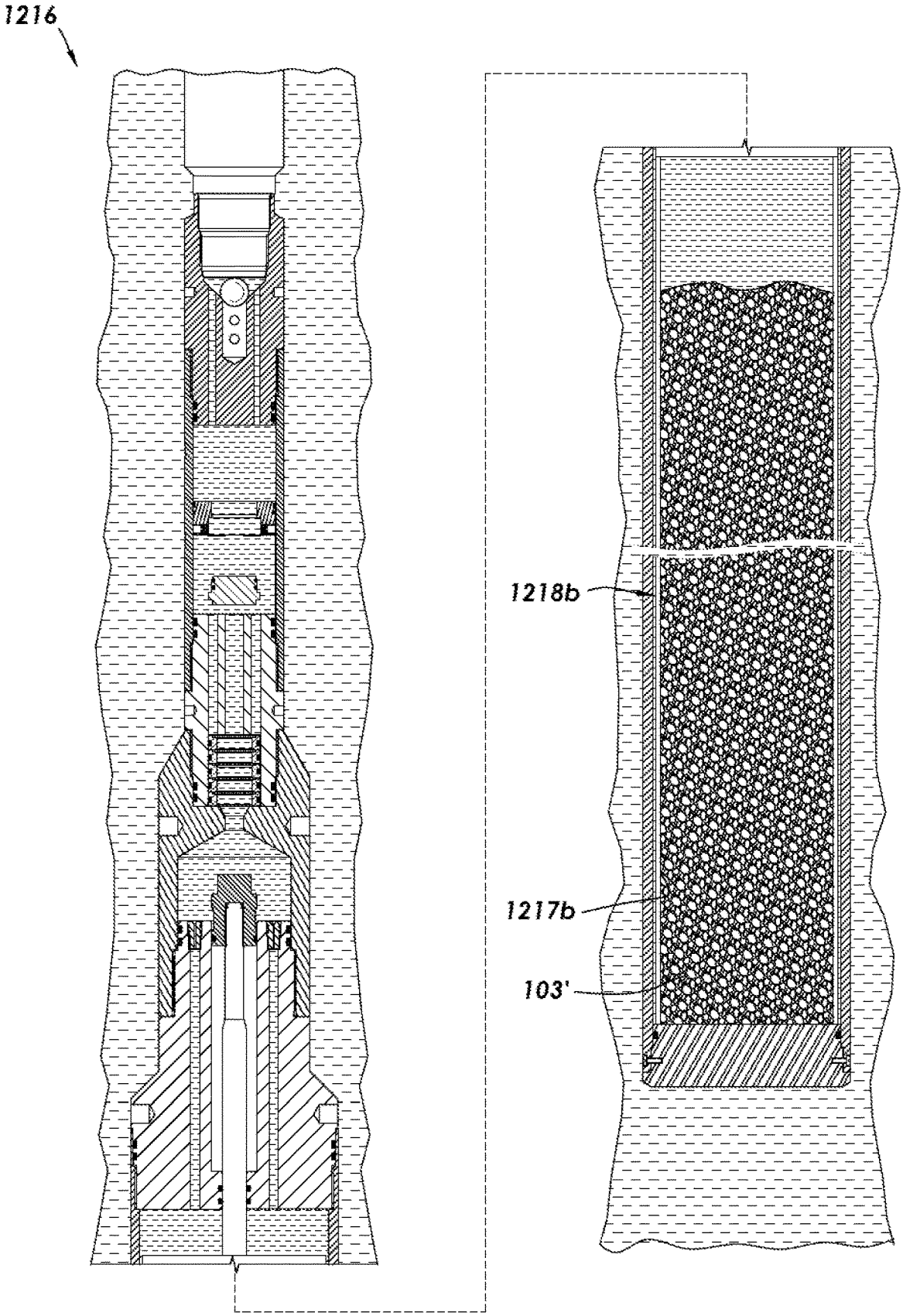

FIGS. 13A-14B show the placement tool 1216 during the wellbore drop operation. As shown in this example, the placement tool 1216 may be used with the pellet wellbore material 103 (or other wellbore material). FIGS. 13A-13C are similar to FIGS. 10A-10C and show the downhole placement tool 216 in a run-in mode, actuated mode, and a placement mode, respectively. FIG. 13A shows the placement tool 1216 positioned at a desired depth in the wellbore 105. In this view, the wellbore fluid 1074 has passed into the actuation portion 118*a*. FIG. 13B shows the fluid after it enters the placement portion 1218*b* and into the pressure chamber 1217*b* to invade and form the fluidized wellbore material 103'.

Figure 13C:
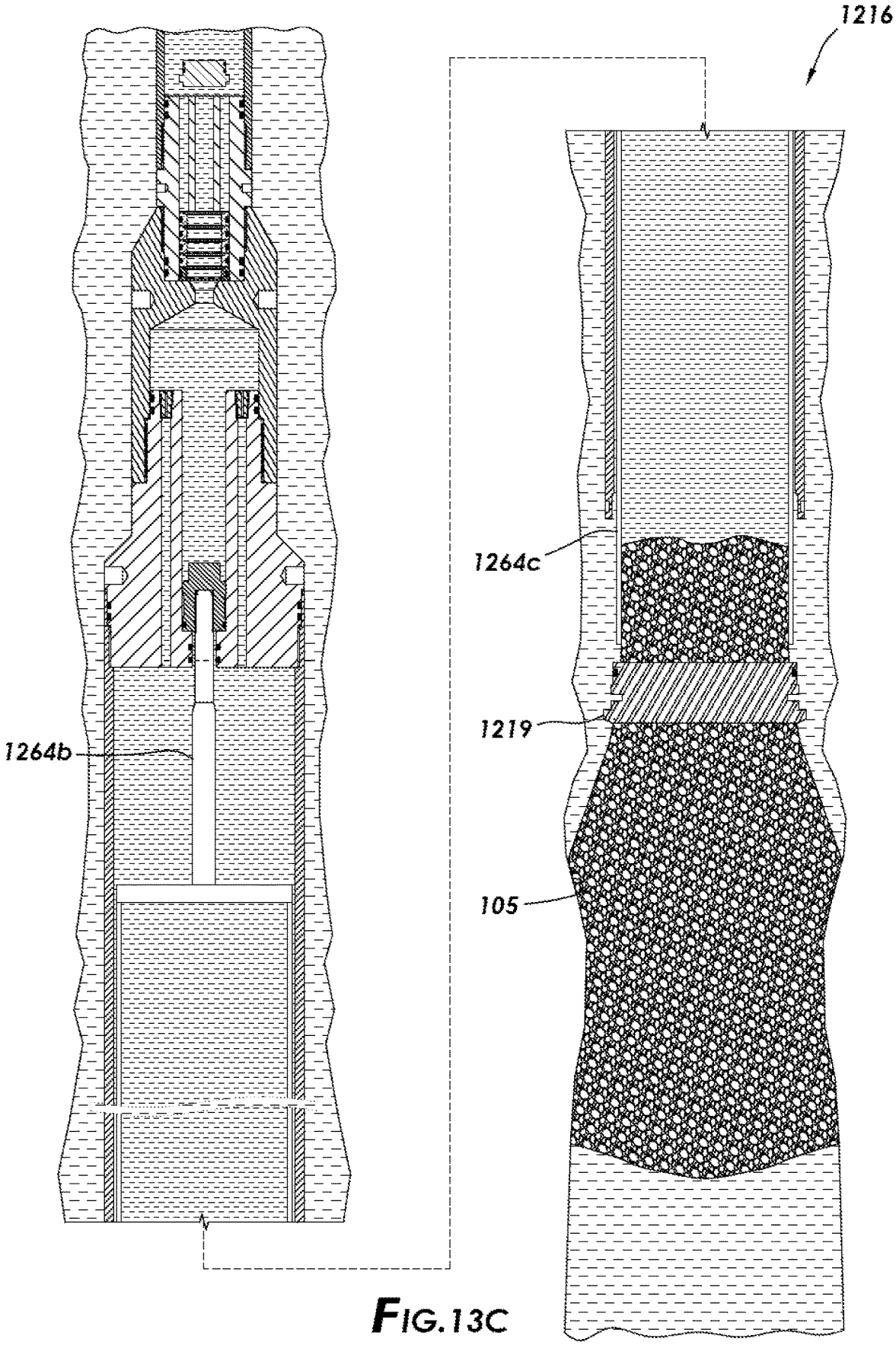

FIG. 13C shows the placement tool 1216 after the pressure in the placement tool 1216 has increased to a level sufficient to push down the peripheral screen 1264*c* and release the door 1219. The door 1219 opens to allow the fluidized wellbore material 103' to fall into the wellbore 105. As also shown in this view, the screen rod 1264*b* and peripheral screen 1264*c* are driven downhole to apply a force to shear the pins 266 and release the door 1219. The fluidized wellbore material 103' is deployed into the wellbore 105 upon breakage of the shear pins 266 (FIG. 12B) and the release of the door 1219.

Figure 14A:
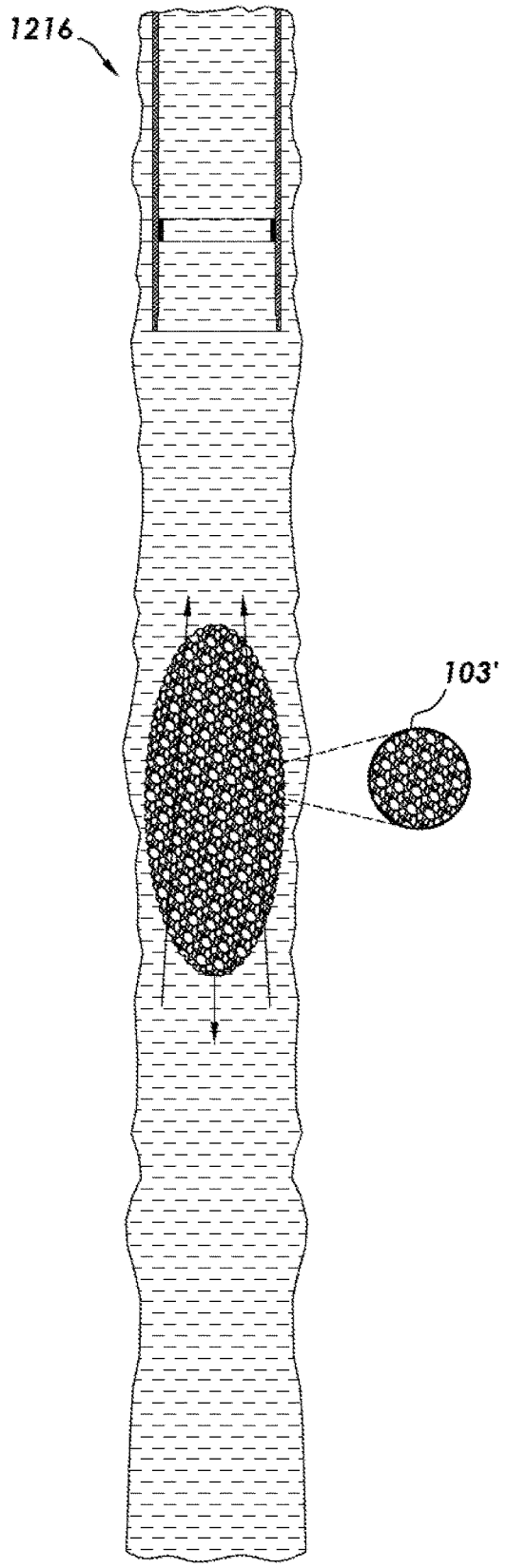
FIGS. 14A-14B show activation of the wellbore material as it is released from the placement tool and passes into the wellbore.
Figure 14B:
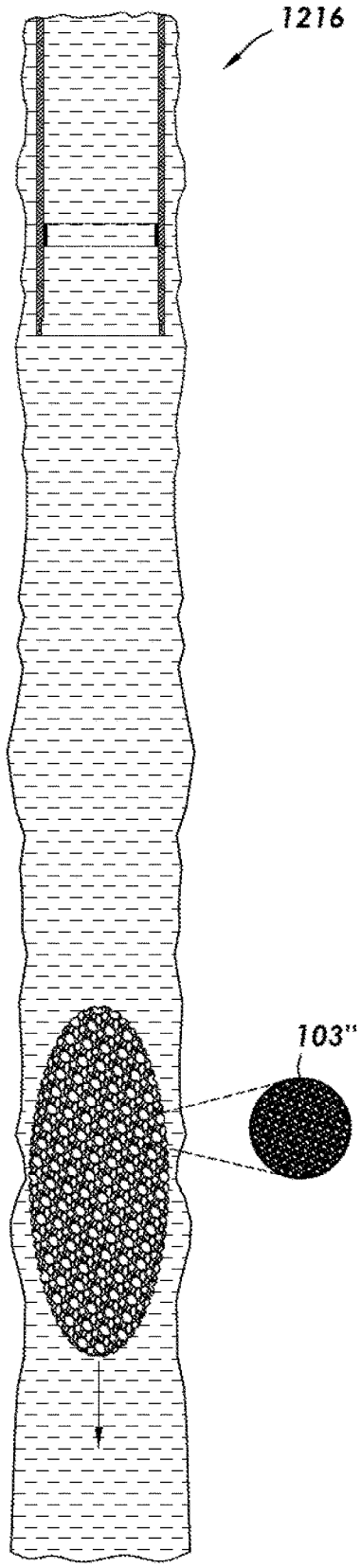

FIG. 14A-14B show activation of the wellbore material 103 during the wellbore drop operation. As shown in these views, the fluidized wellbore mixture 103' falls into the wellbore 105 and the coating 972*a* (FIGS. 11A-11C) is removed as the fluidized wellbore material 103' falls through the wellbore. The fluidized wellbore material 103' falls through the wellbore 105 and is activated to form the activated wellbore material 103" as described in FIGS. 11A and 11B.

Figure 15:
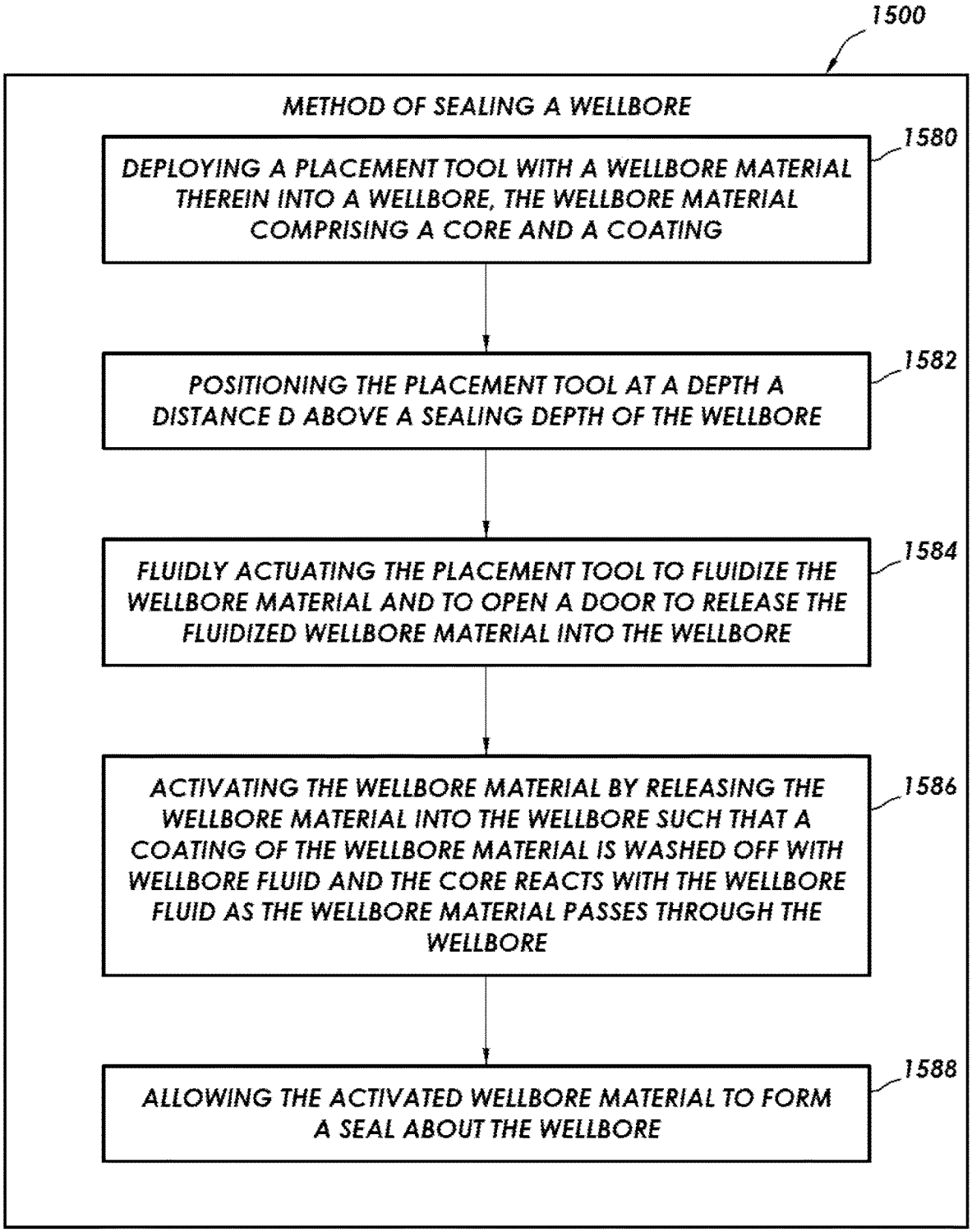
FIG. 15 is a flow chart depicting a method of sealing a wellbore.

FIG. 15 shows a method 1500 of sealing a wellbore. As shown in this example, the method 1500 involves 1580—deploying a placement tool with a wellbore material therein into a wellbore, the wellbore material comprising a core and a coating, 1582—positioning the placement tool at a depth a distance d above a sealing depth of the wellbore, and 1584—fluidly actuating the placement tool to mix a fluid with the wellbore material to form a fluidized wellbore material and to open a door to release the fluidized wellbore material into the wellbore. The placement tool and wellbore material may be those described herein.

The method continues with 1586—activating the wellbore material by releasing the fluidized wellbore mixture into the wellbore such that a coating of the fluidized wellbore material is washed off with wellbore fluid and the core reacts with the wellbore fluid as the fluidized wellbore material passes through the wellbore, and 1588—allowing the activated wellbore material to form a seal about the wellbore.

The method may be performed in any order and repeated as desired.

Figure 16A:
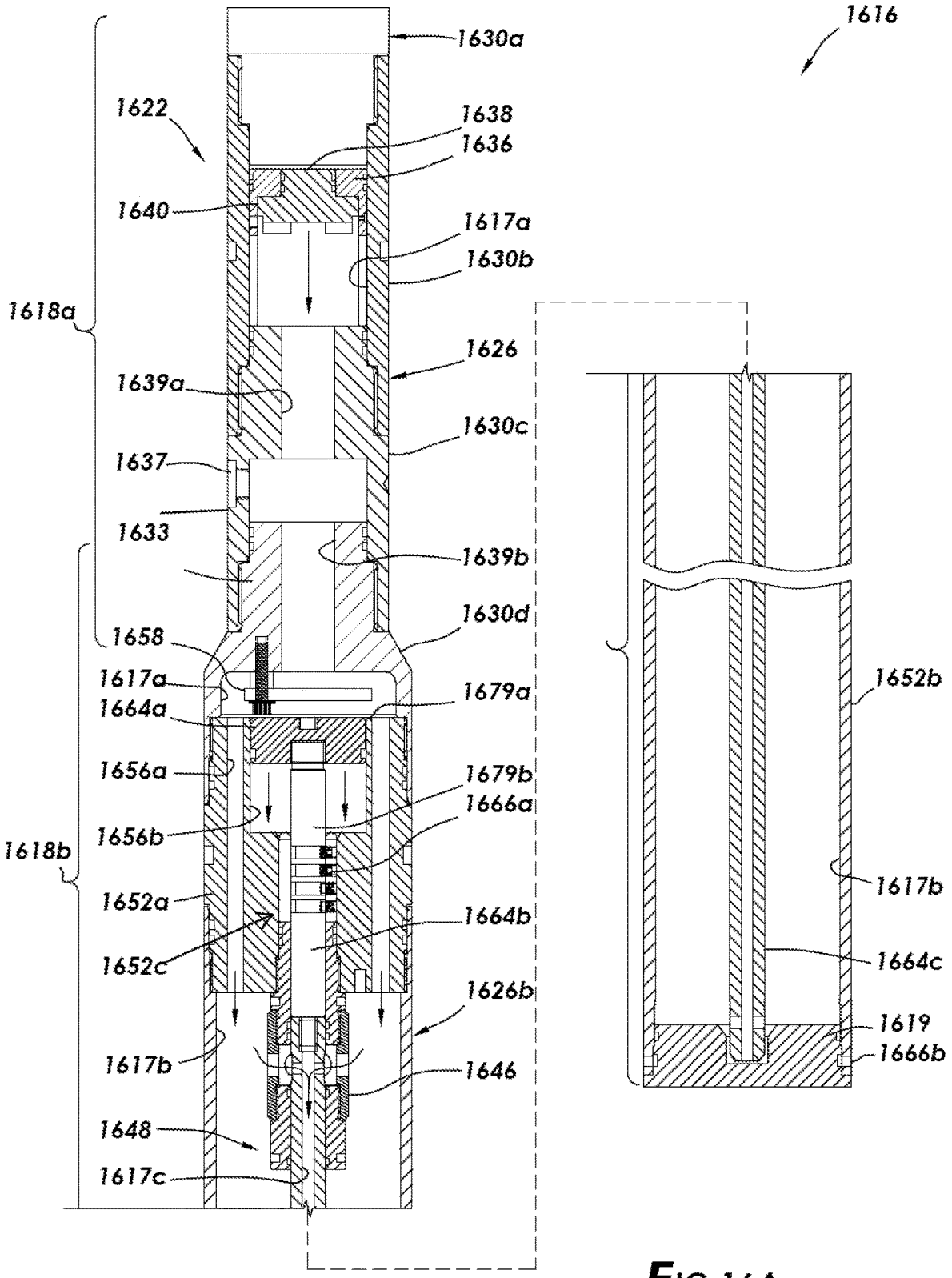
FIGS. 16A-16C show an example deflector placement tool.
Figure 16B:
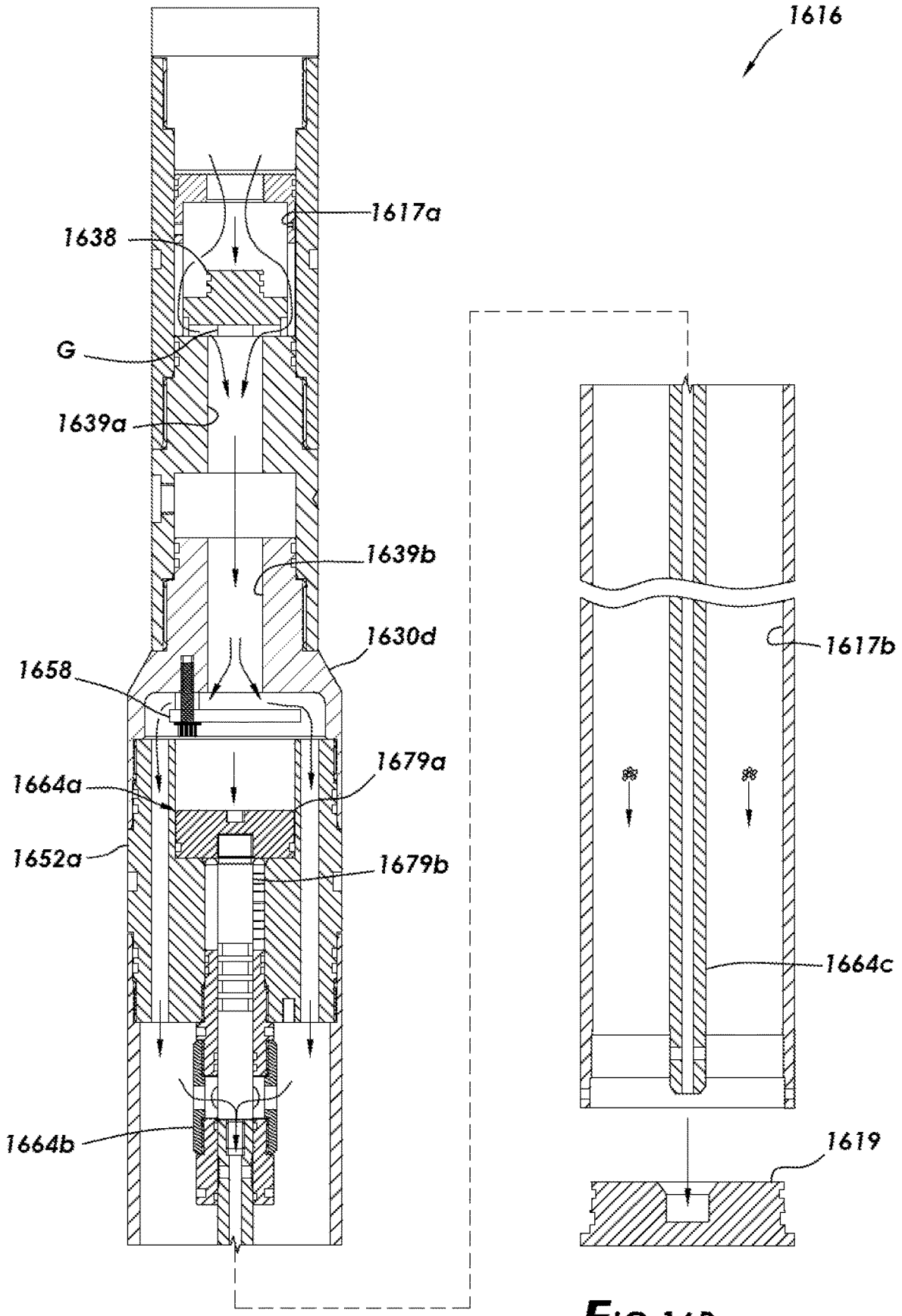
Figure 16C:
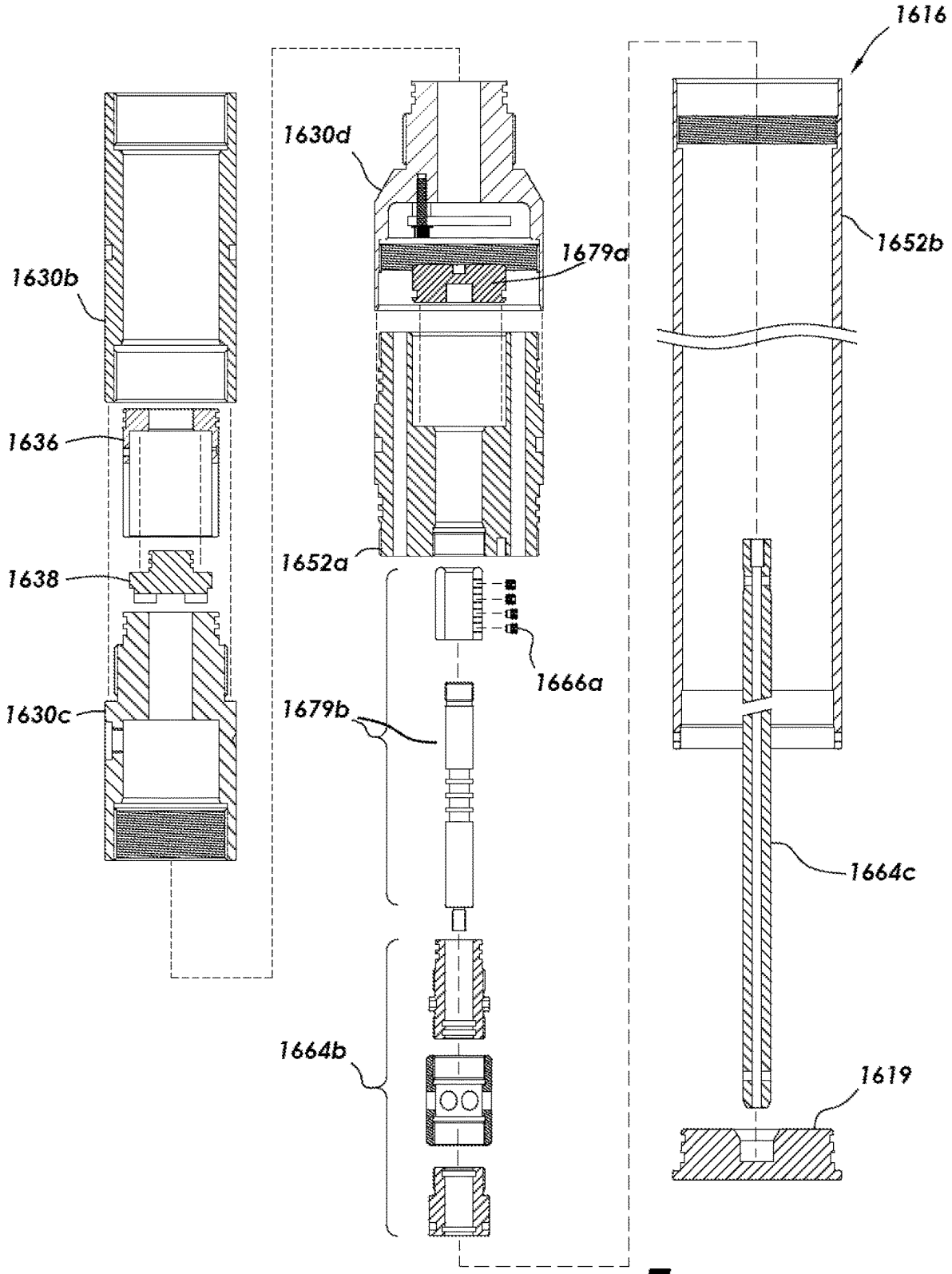

FIGS. 16A-16C show another example deflector placement tool 1616. This version includes an actuation portion 1618*a*, a placement portion 1618*b*, and an actuator crossover 1630*d*. The actuation portion 1618*a* includes a housing 1626 with the fluid chamber 1617*a* and an actuation assembly 1622 therein. The housing 1626 includes circulation sub 1630*a*, a piston collar 1630*b*, and a plug sub 1630*c*. The circulation sub (ball actuator) 1630*a* may be a ball actuated sub, such as 230*a* of FIG. 2A or a hydro-electric actuated sub, such as 530*a* of FIG. 5A.

The piston collar 1630*b* may be a tubular sleeve located between the circulation sub 1630*a* and the plug sub 1630*c* with the fluid chamber 1617*a* defined therein. The piston collar 1630*b* may have ends shaped to receive portions of the circulation and plug subs 1630*a,c*. The piston collar 1630*a* has a support 1636 along an inner surface thereof a distance downhole from the circulation sub 1630*a*. The support 1636 may have a circular inner periphery shaped to receive a shear piston 1638.

The shear piston 1638 may be a flange shaped member removably seated in the support 1636 by shear pins (or screws) 1640. The shear piston 1638 and the support 1636 may define a fluid barrier to fluidly isolate the fluid from entering the placement portion 1618*b*. An upper end of the shear piston 1638 is engagable by fluid passing into the housing 1626. The shear piston 1638 has an outer surface slidably positionable along an inner surface of the housing 1626. The shear piston 1638 also has tabs extending from a bottom surface thereof.

Once sufficient force (e.g., pressure) is applied to the shear pins 1640, the shear piston 1638 may be released to allow the fluid to pass from the fluid chamber 1617*a* and into the placement portion 1618*b* as is described further herein. Upon actuation by application of sufficient fluid force to the upper end of the shear piston 1638, the shear pins 1640 may be broken and the shear piston 1638 may be driven out of the support 1636 and against the plug sub 1630*c* as indicated by the downward arrow in FIG. 16A. The tabs on the bottom of the shear piston 1638 may contact the plug sub 1630*c* to define a flow gap G therebetween as shown in FIG. 16B.

The plug sub 1630*c* is a tubular member with a fluid passage 1639*a* therethrough. An uphole end of the plug sub 1630*c* is shaped for contact by the shear piston 1638 when activated. The shear piston 1638 is positionable against the plug sub 1630*c* with the flow gap G therebetween to permit the passage of fluid therethrough and into the passage 1639*a*.

A downhole end of the plug sub 1630*c* is connectable to the actuator crossover 1630*d*. The downhole end also has a plug insert 1633 seated within the plug sub 1630*c*. The plug insert 1633 has a plug 1637 to allow external access to the deflection chamber 1617*a*. The plug 1637 may be selectively removed to allow fluid to be inserted or exited through the plug insert 1633.

The actuator crossover 1630*d* is threadedly connected between the plug sub 1630*c* and the placement portion 1618*b*. The actuator crossover 1630*d* has a tapered outer surface with an outer diameter that increases to transition from an outer diameter of the plug sub 1630*c* to an outer diameter of an uphole end of the placement portion 118*b*. This tapered outer surface defines an upper portion and a lower portion.

The upper portion of the actuator crossover 1630*d* has a tubular inner surface that is shaped to receive the plug sub 1630*c* at one end. The upper portion also has a fluid passageway 1639*b* extending therethrough. The downhole portion of the actuator crossover 1630*d* is shaped to receive an upper end of the placement portion 1618*b*. A deflection chamber 1617*a* is defined in the downhole portion to receive the fluid passing from the fluid passageway 1639*b*.

A deflection plate 1658 is supported in a downhole end of the actuator crossover 1630*d* by a connector (e.g., screw, bolt, etc.). The deflection plate 1658 may be a circular member with a flat surface that faces an outlet of the deflection chamber 1617*a* to receive the fluid thereon. The deflection plate 1658 may be positioned in the deflection chamber 1617*a* a distance from an outlet of the passageway 1639*b* to receive an impact from force of the fluid applied by the fluid passing out of the passageway 1639*b* and into the metering sub 1652*a*. The deflection plate 1658 may be shaped and/or positioned to deflect such fluid laterally and/or to disperse the fluid through the deflection chamber 1617*a*. This may allow the fluid to pass through the passageway 1639*b* and against the deflection plate 1658 to absorb impact of the fluid and allow the fluid to flow into the placement portion 1618*b* at a slower rate.

The placement portion 1618*b* is threadedly connected to a downhole end of the actuation portion 1618*a* about a downhole end of the actuator crossover 1630*d*. The placement portion 1618*b* includes a housing 1626*b* and a push down piston 1648. The housing 226*b* includes a metering sub 1652*a*, a placement sleeve 1652*b*, and the door 1619, with the pressure chamber 1617*b* defined therein.

The metering sub 1652*a* is a tubular member with flow passages 1656*a* and a central passage 1656*b* for fluid flow therethrough. The metering sub 1652*a* is connectable to a downhole end of the actuator crossover 1630*d* to receive fluid flow therefrom and pass such fluid into the placement sleeve 1652*b*.

The metering sub 1652*a* also includes a metering assembly 1652*c*. The metering assembly 1652*c* includes a metering piston 1664*a*, a valve 1664*b*, and a push rod 1664*c*. The metering piston 1664*a* includes a piston head 1679*a* and a piston rod 1679*b* slidably positionable in the passage 1656*b*.

The piston rod 1679*b* extends from the piston head 1679*a* through the metering sub 1652*a* and into the placement sleeve 1652*b*. Shear pins 1666*a* are provided along the piston rod 1679*b* to prevent movement of the piston head 1679*a* until sufficient flow passes into the metering sub 1652*a*. The piston rod 1679*b* is slidably positionable through the valve 1664*b*. The push rod 1664*c* is connected to a downhole end of the piston rod 1679*b* and extends through the placement portion 1618*b*.

The metering sub 1652*a* is threadedly connected between the actuator crossover 1630*d* and the placement sleeve 1652*b*. The metering sub 1652*a* includes has an uphole end threadedly connectable to the actuator crossover 1630*d* and receivable in the deflection chamber 1617*a* and a downhole end threadedly connected to the placement sleeve 1652*b* and extending therein. The metering sub 1652*a* has an outer surface positioned between the actuator crossover 1630*d* and the placement sleeve 1652*b*.

The metering sub 1652*a* is a solid member with metering passages 1656*a* extending between the chamber 1617*a* and 1617*b* for fluid passage therethrough, and a piston passage 1656*b* for slidingly receiving the piston 1648 therethrough. The push down piston 1648 extends through the metering sub 1652*a* and the placement sleeve 1652*b*. The push down piston 1648 includes a piston head 1679*a*, a piston rod 1679*b*, and a push rod 1664*c*. The piston head 1679*a* is slidably positionable in the passage 1656*b* of the metering sub 1652*a*.

The piston rod 1679*b* is connected to the piston head and extends through the metering sub 1652*a* and into the pressure chamber 1617*b*. The push rod 1664*c* is slidably connected between the piston rod 1679*b* and the door 1619. The piston rod 1679*b* may be telescopically connected to the push rod 1664*c* and move axially therealong.

As the piston head 1679*a* is driven downward by fluid force from the fluid in chamber 1617*a*, the piston rod 1679*b* may slidingly pass along the push rod 1664*c*. The shear pins 1666*a* may be positioned about the piston rod 1679*b* to prevent movement of the piston 1648 until sufficient fluid force is generated. Once sufficient fluid force drives the piston head 1679*a* downward, the shear pins 1666*a* may be broken from the piston rod 1679*b* to allow the piston head 1679*a* and the piston rod 1679*b* to move.

The push rod 1664*c* may be hollow to permit fluid to pass into chamber 1617*b* therein. The valve 1664*b* may be positioned about the piston rod 1679*b* and the push rod 1664*c* to selectively permit fluid to pass into the push rod 1664*c*. The valve 1664*b* is a tubular sleeve secured in a downhole end of the metering sub 1652*a* in the passage 1656*b*. The valve 1664*b* has inlets to receive fluid from chamber 1617*b* therein. The inlets are in selective fluid communication with the chamber 1617*c* in the push rod 1664*c* depending on a position of the piston rod 1679*b*. The inlets of the valve 1664*b* are in the open position as shown in FIG. 16A until the piston head 1679*a* and the piston rod 1679*b* advance a predetermined distance downhole to close the inlets of the valve 1664*b*.

The placement sleeve 1652*b* may be a tubular member similar to the placement sleeves described herein. This placement sleeve 1652*b* is connected to a downhole end of the metering sub 1652*a*. The placement sleeve 1652*b* may be shaped to house the wellbore material (e.g., 103, 503, etc.) and the fluid passing into the pressure chamber 1617*b*.

The door 1619 is secured by shear pins 1666*b* to a downhole end of the placement sleeve 1652*b*. The door 1619 may be removed and the placement tool 1616 inverted to allow the placement sleeve 1652*b* to be filled with the wellbore material. Optionally, fluid may be placed into the pressure chamber 1617*b* prior to adding the wellbore material. As wellbore material is added, the fluid may be displaced and spill out of the pressure chamber 1617*b*. Once filled, the door 1619 may be closed, and the placement tool 1616 returned to its upright position for placement in the wellbore. Optionally, the chamber 1617*b* may be pressurized with air or vacuum.

When fluid contacts the piston head 1679*a*, the piston head 1679*a* and the piston rod 1679*b* are drive downward. Fluid flows through the inlets of the valve 1664*b* and into a chamber 1617*c* within the push rod 1664*c* as indicated by the arrows in FIG. 16B. Once the piston head 1679*a* bottoms out, the valve 1664*b* closes and prevents any additional fluid from passing into the push rod 1664*c*. The fluid from the metering sub 1652*a* may continue to pass into the placement sleeve 1652*b*. until the weight of the fluid and the wellbore material in the placement sleeve 1652*b* is sufficient to shear the shear pins 1666*b* in the door 1619.

The placement tool 1616 may have features described in other placement tools herein. For example, the housing and subs may be threadedly connected, filtration devices may optionally position in the placement tool 1616, various features of push rods may be used, and various wellbore materials may be positioned in the pressure chamber 1617*b*.

In an example operation, the placement tool 1616 is assembled and inverted for filling. Fluid, such as water, is placed in the pressure chamber 1617*b* having a 4" (10.16 cm) internal diameter. Scoops of 0.25" (0.63 cm) pellets of the wellbore material 103 is inserted into the pressure chamber 1617*b* and displaces 75% of the fluid. The door 1619 is secured on the tool 1616 to enclose the wellbore material 103 therein. The wellbore material 103 and fluid form a 10' (3.05 m) tall column of hydrated (fluidized) wellbore material 103'. The placement tool 1616 is then inverted to an upright position and the wellbore material 103' allowed to hydrate inside for 4 hours. The placement tool 1616 is positioned in a wellbore lined with acrylic casing having a 7" (17.78 cm) outer diameter and a 6.5" (16.51 cm) inner diameter. The placement tool is positioned 12' (3.66 m) above the bottom of the casing.

The actuation assembly 1622 is triggered by pumping pressurized fluid from the surface and through a ball actuator 1630*a* of FIG. 2A in the placement tool 1616 for 15 seconds. The shear pins 1640 are broken and the shear piston 1638 is released from the support 1636. The fluid passes through the opening in the support 1636, through passageway 1639*a*, past the deflection plate 1658 in deflection chamber 1617*a*, through flow passages 1656*a*, and into the pressure chamber 1617*b*. The fluid in pressure chamber 1617*b* hydrates the wellbore material 103 and causes the shear pins to break and release the door 1619. The hydrated wellbore material 103' is then released to fall into the wellbore where it may continue to expand and seal a portion of the wellbore.

When the pellets of wellbore material 103 are loaded into the pressure chamber 1617*b*, air gaps are located between the pellets. As fluid fills the pressure chamber 1617*b* and hydrates the wellbore material 103, 4.2 gallons (15.90 l) of mass (matter) of hydrated wellbore material 103' is formed. The hydrated wellbore material 103' forms a monolithic, cylindrical column with a 4" (10.16 cm) diameter and a 20' (6.10 m) length corresponding to the shape of the pressure chamber 1617*b* in the placement tool 1616.

The 2.5' (0.76 m) tall and 4" (10.16 cm) diameter dry monolithic mass of the hydrated wellbore material 103' (with no gaps between) and having 4.3 gallons of mass volume is placed in the casing. When released, the monolithic column of the hydrated wellbore material 103' is expelled and settles in the bottom of the wellbore. Over a 12 hour period, the hydrated wellbore material 103' expands and flows as it continues to hydrate within the wellbore until activated. The mass of the activated wellbore material 103' in the wellbore expands to a volume of about 260% (10.4 gallons of mass volume; 39.37 l) of the original dry wellbore material 103 (4.3 gallons of mass volume; 16.28 l) placed into the placement tool 1616. The activated wellbore material 103" expands in the wellbore by 260% to 10.4 gallons (39.37 l) mass volume. The size of the activated wellbore material 103" also expands to 6.5 ft (1.98 m) long within the 6.5" (16.51 cm) ID casing and to 11.24 gallons of mass volume.

Variations of the operation may be performed to place 20-30 feet (6.10-9.14 m) of the monolithic column of the wellbore material from the placement tool 1616 into the wellbore. For example, the wellbore material may swell differently based on the type of fluid used. Factors, such as salinity or temperature of the fluid, may affect swelling. Wellsite conditions (e.g., wellbore fluids, shape of wellbore material, etc.) may also alter the amount of swelling volume expansion (e.g., about 200+% volume expansion). Operating conditions, such as size of the pressure chamber 1617*b*, the size of the wellbore, and/or the amount of wellbore material used may alter the size and/or shape of the cylindrical column placed in the wellbore. For example, the size of the column of wellbore material may affect time and amount of expansion. Similarly, the size of the wellbore may affect the size and shape of the expanded wellbore material in the wellbore.

While the embodiments are described with reference to various implementations and exploitations, it will be understood that these embodiments are illustrative and that the scope of the inventive subject matter is not limited to them. Many variations, modifications, additions and improvements are possible. For example, various combinations of one or more of the features provided herein may be used. The placement tools described herein have various configurations and components usable for placement of various wellbore materials in the wellbore. The placement tools may have various combinations of one or more of the components described herein.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the disclosed features are not dedicated to the public and the right to file one or more applications to claim such additional features is reserved. Although a narrow claim may be presented herein, it should be recognized the scope of this disclosure is much broader than presented by the claim(s). Broader claims may be submitted in an application claims the benefit of priority from this application.

What is claimed is:

1. A downhole placement tool for placing a wellbore material in a wellbore, the downhole placement tool comprising:

an actuation assembly comprising an actuation housing having a fluid pathway therethrough and an actuation piston seated in the actuation housing to block the fluid pathway, the actuation piston movable by fluid applied thereto to open the fluid pathway and allow the fluid to pass through the fluid pathway; and a placement assembly connected to the actuation assembly, the placement assembly comprising:

a placement housing having a pressure chamber to store the wellbore material therein;

a door positioned in an outlet of the placement housing; and a placement piston positioned in the placement housing, the placement piston comprising a piston head and a placement rod, the piston head slidably movable in the placement housing, the placement rod connected between the piston head and the door, the piston head movable in response to flow of the fluid from the actuation assembly into the placement assembly to advance the placement piston and open the door whereby the wellbore material is selectively released into the wellbore.

2. The downhole placement tool of claim 1, wherein the actuation assembly further comprises one of a ball actuator and an electro-hydraulic actuator.

3. The downhole placement tool of claim 1, wherein the actuation assembly further comprises a support positioned in the actuation housing and wherein the actuation piston comprises a disc removably seated in an opening in the support.

4. The downhole placement tool of claim 1, wherein the actuation assembly further comprises a rupture disc positioned in the actuation housing and wherein the actuation piston comprises a piercing rod having a tip extendable through the rupture disc.

5. The downhole placement tool of claim 1, further comprising a deflection plate between the actuation assembly and the placement assembly.

6. The downhole placement tool of claim 1, wherein the actuation assembly further comprises a filtration or a plug sub.

7. The downhole placement tool of claim 1, wherein the actuation assembly further comprises a sub with the fluid pathway extending therethrough, and wherein the actuation piston has tabs at a downhole end thereof positionable against the sub to define a fluid gap therebetween.

8. The downhole placement tool of claim 1, further comprising shear pins releasably positioned about at least one of the actuation piston, the placement housing, the actuation housing, the door, and the placement rod.

9. The downhole placement tool of claim 1, further comprising filters positionable in the fluid pathway.

10. The downhole placement tool of claim 1, further comprising a crossover sub connecting the actuation assembly to the placement assembly.

11. The downhole placement tool of claim 1, wherein the placement assembly further comprises a metering sub with channels for passing fluid from the actuation assembly into the pressure chamber.

12. The downhole placement tool of claim 1, further comprising a perforated sleeve with a hole to receive the placement rod therethrough.

13. The downhole placement tool of claim 1, wherein the placement rod comprises a piston rod and a push rod, the piston rod connected to the piston head and movable therewith, the push rod connected to the door and having a hole to slidingly receive an end of the piston rod.

14. The downhole placement tool of claim 13, further comprising a valve positioned about the push rod to selectively permit fluid to pass into the push rod.

15. The downhole placement tool of claim 1, further comprising a disc supported in the pressure chamber, the placement rod extending through the disc.

16. The downhole placement tool of claim 1, further comprising a peripheral screen slidingly positionable in the placement housing, the peripheral screen comprising a plate with a hole to receive the placement rod therethrough and a tubular screen, the tubular screen extending from the plate.

17. The downhole placement tool of claim 1, wherein the wellbore material comprises bentonite.

18. The downhole placement tool of claim 1, wherein the pressure chamber is shaped to receive the wellbore material having one of a spherical shape, a disc shape, a box shape, a fluted shape, a cylindrical shape, and combinations thereof.

19. The downhole placement tool of claim 1, wherein the wellbore material has a cylindrical body with peripheral cuts extending from a periphery towards a center thereof, the peripheral cuts shaped to permit passage of the fluid therein.

20. The downhole placement tool of claim 1, wherein the pressure chamber has a vacuum therein.

21. A method of placing a wellbore material in a wellbore, the method comprising:

placing the wellbore material in a pressure chamber of a placement tool;

deploying the placement tool into the wellbore; and releasing the wellbore material into the wellbore by:

pumping fluid from a surface location into the placement tool to unblock a blocked fluid pathway to the pressure chamber; and allowing the fluid to pass from the fluid pathway and into the pressure chamber to increase a pressure in the pressure chamber sufficient to open a door of the pressure chamber.

22. The method of claim 21, further comprising triggering the fluid to flow from the surface location and into the fluid pathway.

23. The method of claim 21, wherein the pumping comprises creating an opening in the fluid pathway by unseating a placement piston from a support in the fluid pathway.

24. The method of claim 21, wherein the pumping comprises creating an opening in the fluid pathway by driving a piercing piston through a rupture disc.

25. The method of claim 21, wherein the releasing comprises deflecting the fluid as it passes into the pressure chamber.

26. The method of claim 21, wherein the releasing comprises opening the door by applying pressure from the fluid to a placement piston connected to the door.

27. The method of claim 21, further comprising pressurizing the pressure chamber with a vacuum.

28. A method of placing a wellbore material in a wellbore, the method comprising:

placing the wellbore material in a pressure chamber of a placement tool;

deploying the placement tool into the wellbore;

opening a fluid pathway to the pressure chamber by pumping fluid from a surface location and into the deployed placement tool; and releasing the wellbore material into the wellbore by passing the fluid through the fluid pathway and into the pressure chamber until a pressure in the pressure chamber is sufficient to open a door to the pressure chamber.

29. The method of claim 28, further comprising fluidizing the wellbore material by adding fluid to the pressure chamber after the placing and before the deploying.

30. The method of claim 28, further comprising activating the wellbore material by exposing a core of the wellbore material to a wellbore fluid in the wellbore.

31. The method of claim 30, wherein the activating comprises dropping the wellbore fluid a distance in the wellbore sufficient to wash away a coating of the wellbore material and expose the core to the wellbore material.

32. The method of claim 28, wherein the deploying comprises deploying the placement tool to a depth a distance above a sealing location, the method further comprising activating the wellbore material by dropping the wellbore material through the wellbore and allowing wellbore fluid in the wellbore to wash away a coating of the wellbore material as the wellbore material falls through the wellbore.

33. The method of claim 28, further comprising pressurizing the pressure chamber with a vacuum.

* * * * *